US009815279B1

(12) United States Patent
Kiji et al.

(10) Patent No.: US 9,815,279 B1
(45) Date of Patent: Nov. 14, 2017

(54) INKJET HEAD DRIVE APPARATUS

(71) Applicant: TOSHIBA TEC KABUSHIKI KAISHA, Shinagawa-ku, Tokyo (JP)

(72) Inventors: Yasuhito Kiji, Shizuoka (JP); Ryutaro Kusunoki, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/145,242

(22) Filed: May 3, 2016

(51) Int. Cl.
*B41J 2/045* (2006.01)

(52) U.S. Cl.
CPC ..... *B41J 2/04588* (2013.01); *B41J 2/04541* (2013.01); *B41J 2/04586* (2013.01)

(58) Field of Classification Search
CPC B41J 2/04588; B41J 2/04541; B41J 2/04581; B41J 2/04595
See application file for complete search history.

(56) References Cited

U.S. PATENT DOCUMENTS

| | | | | |
|---|---|---|---|---|
| 6,106,092 | A | 8/2000 | Norigoe et al. | |
| 2012/0218333 | A1 | 8/2012 | Nishikawa | |
| 2012/0306954 | A1* | 12/2012 | Nishikawa | B41J 2/04516 347/11 |
| 2016/0082723 | A1 | 3/2016 | Mawatari | |

FOREIGN PATENT DOCUMENTS

| | | |
|---|---|---|
| JP | 2000-015803 | 1/2000 |
| JP | 2009-233946 | 10/2009 |
| JP | 2012-045797 | 3/2012 |
| JP | 2012-126046 | 7/2012 |
| JP | 2012-187920 | 10/2012 |
| JP | 2012-250477 | 12/2012 |
| WO | 2014/185142 | 2/2017 |

OTHER PUBLICATIONS

Japanese Office Action for Japanese Patent Application No. 2015-067300 dated Jul. 11, 2017.

* cited by examiner

*Primary Examiner* — Jason Uhlenhake
(74) *Attorney, Agent, or Firm* — Amin, Turocy & Watson LLP

(57) ABSTRACT

An inkjet head drive apparatus comprises a pressure chamber, an actuator, a nozzle and a drive signal output section. The pressure chamber accommodates an ink. The actuator increases or decreases volume of the pressure chamber through an applied a voltage. The nozzle is connected with the pressure chamber to eject the ink through the change in the volume of the pressure chamber. When an ejection pulse for the ejection of the ink from the nozzle is repeated for equal to or greater than three times, the drive signal output section outputs a drive signal having a driving waveform including an initial ejection pulse having a first voltage amplitude and the a second ejection pulses and the pulses thereafter having a second voltage amplitude smaller than the first voltage amplitude to the actuator.

11 Claims, 21 Drawing Sheets

| SIMULATION OF SPEED OF INK DROPLET (AL:2.2[μs],PULSE WIDTH:2.2[μs],PULSE INTERVAL:4.4[μs]) | | | |
|---|---|---|---|
| POTENTIAL DIFFERENCE OF FIRST EJECTION PULSE [v] | POTENTIAL DIFFERENCE OF SECOND EJECTION PULSE [v] | SPEED OF INK DROPLET BY FIRST EJECTION PULSE [m/s] | SPEED OF INK DROPLET BY SECOND EJECTION PULSE [m/s] |
| 25 | 10 | 9.283 | 6.485 |
| 25 | 11 | 9.562 | 7.398 |
| 25 | 12 | 9.770 | 8.580 |
| 25 | 13 | 9.406 | 9.305 |
| 25 | 14 | 9.888 | 9.888 |
| 25 | 15 | 9.612 | 9.612 |
| 25 | 16 | 10.072 | 10.072 |
| 25 | 17 | 10.722 | 10.722 |

| EJECTION SPEED AND EJECTION VOLUME (AL:2.2[μs],PULSE WIDTH:2.2[μs],PULSE INTERVAL:4.4[μs]) | | |
|---|---|---|
| DROP NUMBER | EJECTION SPEED[m/s] | EJECTION VOLUME[pL] |
| 1 | 9.623 | 5.08 |
| 2 | 10.072 | 11.25 |
| 3 | 12.353 | 19.48 |
| 4 | 13.826 | 27.68 |
| 5 | 14.256 | 37.63 |
| 6 | 13.709 | 47.13 |
| 7 | 14.698 | 57.02 |

| CHANGE OF PULSE WIDTH (AL:2.2[μs],PULSE INTERVAL:4.4[μs],POTENTIAL DIFFERENCE OF FIRST EJECTION PULSE:25[v],POTENTIAL DIFFERENCE OF SECOND EJECTION PULSE:16[v]) | | | |
|---|---|---|---|
| DROP NUMBER | PULSE WIDTH[μs] | EJECTION SPEED[m/s] | EJECTION VOLUME[pL] |
| 1 | 2.20 | 9.623 | 5.08 |
| 2 | 2.20 | 10.072 | 11.25 |
| 3 | 1.40 | 10.329 | 17.88 |
| 4 | 1.30 | 10.795 | 25.43 |
| 5 | 1.15 | 10.249 | 31.78 |
| 6 | 1.20 | 10.323 | 39.95 |
| 7 | 1.20 | 10.110 | 46.95 |

FIG.20

| MENISCUS AFTER EJECTION[pL] (AL:2.2[μs]) | | | |
|---|---|---|---|
| CANCELLATION PULSE WIDTH[μs] | 1.4(<AL) | 2.8(>AL) | 3.4(>AL) |
| MAX(MAXIMAL VALUE) | 1.73 | 1.45 | 1.58 |
| MIN(MINIMAL VALUE) | -0.99 | -0.77 | -0.57 |
| MAX-MIN | 2.72 | 2.22 | 2.15 |

AMOUNT OF PROTRUSION OF MENISCUS[pL]
(AL:2.2[μs],PULSE INTERVAL:4.4[μs],POTENTIAL DIFFERENCE OF FIRST EJECTION PULSE:25[v],POTENTIAL DIFFERENCE OF SECOND EJECTION PULSE:16[v])

| WIDTH OF CANCELLATION PULSE(μs) / CONTINUOUSLY EJECTED DROPLET NUMBER | 0.8 | 1 | 1.2 | 1.4 | 1.6 | 1.8 | 2 | 2.2 | 2.4 | 2.6 | 2.8 | 3 | 3.2 | 3.4 | 3.6 | 3.8 | PULSE WIDTH(μs) |
|---|---|---|---|---|---|---|---|---|---|---|---|---|---|---|---|---|---|
| 1 | 0.55 | 0.31 | 0.37 | 0.43 | 0.50 | 0.66 | 1.00 | 0.97 | 1.16 | 1.03 | 0.85 | 0.58 | 0.21 | 0.21 | 0.29 | 0.64 | 2.2 |
| 2 | 2.26 | 1.71 | 1.37 | 1.24 | 1.18 | 1.18 | 1.18 | 1.17 | 1.16 | 1.10 | 1.06 | 1.04 | 1.08 | 1.26 | 1.74 | 2.59 | 2.2 |
| 3 | 3.14 | 2.41 | 1.98 | 1.86 | 1.86 | 1.92 | 1.94 | 1.89 | 1.84 | 1.79 | 1.65 | 1.48 | 1.60 | 1.70 | 2.21 | 2.93 | 1.4 |
| 4 | 2.38 | 1.58 | 1.31 | 1.29 | 1.37 | 1.43 | 1.37 | 1.35 | 1.29 | 1.20 | 1.08 | 1.02 | 1.08 | 1.44 | 1.83 | 2.42 | 1.3 |
| 5 | 1.67 | 0.88 | 0.48 | 0.71 | 0.67 | 0.77 | 0.82 | 0.77 | 0.83 | 0.58 | 0.37 | 0.28 | 0.18 | 0.36 | 0.72 | 1.41 | 1.15 |
| 6 | 1.43 | 0.71 | 0.26 | 0.09 | 0.11 | 0.28 | 0.26 | 0.40 | 0.23 | 0.27 | 0.08 | 0.01 | 0.07 | 0.19 | 0.72 | 1.60 | 1.2 |
| 7 | 3.33 | 2.37 | 2.01 | 1.73 | 1.75 | 1.86 | 1.88 | 1.82 | 1.76 | 1.61 | 1.45 | 1.46 | 1.55 | 1.58 | 2.07 | 2.78 | 1.2 |

FIG.21

| CONTINUOUSLY EJECTED DROPLET NUMBER | WIDTH OF CANCELLATION PULSE[μs] | |
|---|---|---|
| | LOWER LIMIT | UPPER LIMIT |
| 1 | 3.2 | 3.6 |
| 2 | 2.2 | 3.2 |
| 3 | 2.4 | 3.4 |
| 4 | 2.4 | 3.2 |
| 5 | 2.8 | 3.4 |
| 6 | 2.8 | 3.2 |
| 7 | 2.6 | 3.4 |

INKJET HEAD DRIVE APPARATUS

CROSS-REFERENCE TO RELATED APPLICATION

This application is based upon and claims the benefit of priority from Japanese Patent Application No. 2015-067300, filed Mar. 27, 2015, the entire contents of which are incorporated herein by reference.

FIELD

Embodiments described herein relate generally to an inkjet head drive apparatus.

BACKGROUND

An inkjet head drive apparatus ejects ink droplets with an ejection pulse having the waveform of maintaining a specific voltage value only within the duration of a pulse width. An inkjet head drive apparatus with a multi-drop system adjusts the quantity of ink droplets by ejecting ink droplets for several times. This kind of the drive apparatus controls the ejection of the second and the following ink droplets by taking the vibration caused by the ejection of the first ink droplet in a pressure chamber into consideration. For example, if there are various kinds of voltage amplitudes (voltage values) of ejection pulses, then a drive apparatus needs to be equipped with a plurality of types of voltage sources, and therefore is large in scale and expensive in cost. Further, by wholly unifying the voltage amplitudes of different ejection pulses, the amount of the ejected ink may be controlled based on a pulse width. However, a drive apparatus with specific voltage amplitudes of ejection pulses consumes more power than a drive apparatus capable of controlling voltage amplitudes of ejection pulses.

DESCRIPTION OF THE DRAWINGS

FIG. 4(*b*) is a longitudinal sectional view of a second section of the head substrate;

FIG. 5(*b*) is a schematic diagram illustrating a state in which the volume of a pressure chamber is increased;

FIG. 8(*b*) exemplifies a driving waveform in a case of the continuous ejection of two ink droplets; FIG. 8(*c*) exemplifies a driving waveform in a case of the ejection of one ink droplet;

FIG. 14(*b*) exemplifies a driving waveform in a case of the continuous ejection of four ink droplets; FIG. 14(*c*) exemplifies a driving waveform in a case of the continuous ejection of two ink droplets;

FIG. 18(*b*) is a schematic diagram illustrating the occurrence of a concave meniscus;

FIG. 20 is a diagram summarizing the maximal value and the minimal value of the protrusion amount of a meniscus formed after the ejection of an ink droplet;

FIG. 21 is a diagram exemplifying the maximal value of the protrusion of a meniscus formed when the number of continuously ejected ink droplets and the pulse width of a cancellation pulse are changed;

DETAILED DESCRIPTION

In accordance with an embodiment, an inkjet head drive apparatus comprises a pressure chamber, an actuator, a nozzle and a drive signal output section. The pressure chamber accommodates ink. The actuator expands or compresses the volume of the pressure chamber through an applied voltage. The nozzle is connected with the pressure chamber to eject the ink through the change in the volume of the pressure chamber. If an ejection pulse for ejecting ink from the nozzle is repeated for equal to or greater than three times, the drive signal output section outputs a drive signal having a driving waveform including an initial ejection pulse having a first voltage amplitude and a second ejection pulse and pulses thereafter having a second voltage amplitude smaller than the first voltage amplitude to the actuator.

Embodiments are described below with reference to the accompanying drawings.

Figure 1:
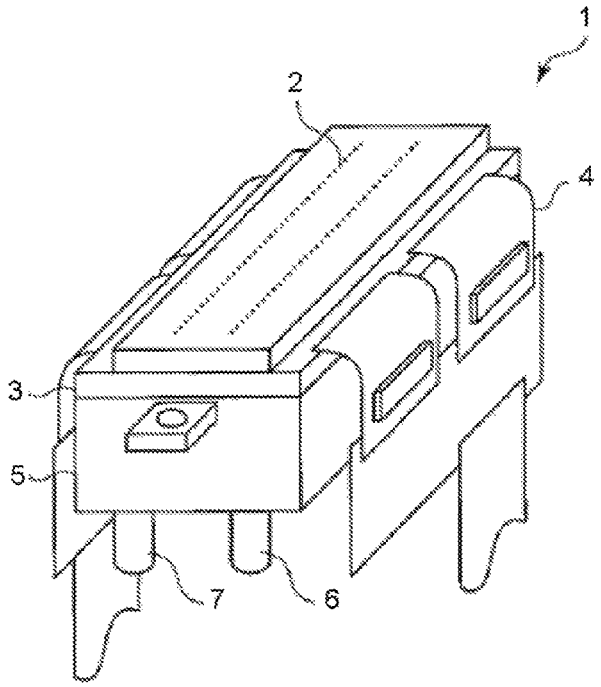
FIG. 1 is a perspective view of an inkjet head used in an inkjet recording apparatus equipped with an inkjet head drive apparatus according to an embodiment.

FIG. 1 is a perspective view of an inkjet head 1 used in an inkjet recording apparatus equipped with an inkjet head drive apparatus according to the present embodiment.

The inkjet head 1 comprises a nozzle 2, a head substrate 3, a driver IC (a drive circuit and a drive signal output section) 4 and a manifold 5. Further, the manifold 5 comprises an ink supply port 6 and an ink discharging port 7.

The nozzle 2 which ejects ink is arranged on the head substrate 3. The driver IC 4 is a drive circuit which outputs a drive signal for the ejection of ink droplets from the nozzle 2. The ink supply port 6 supplies ink for the nozzle 2. The nozzle 2 ejects ink droplets supplied from the ink supply port 6 according to the drive signal applied by the driver IC 4. The ink discharging port 7 discharges the ink that is supplied from the ink supply port 6 but not ejected from the nozzle 2.

Figure 2:
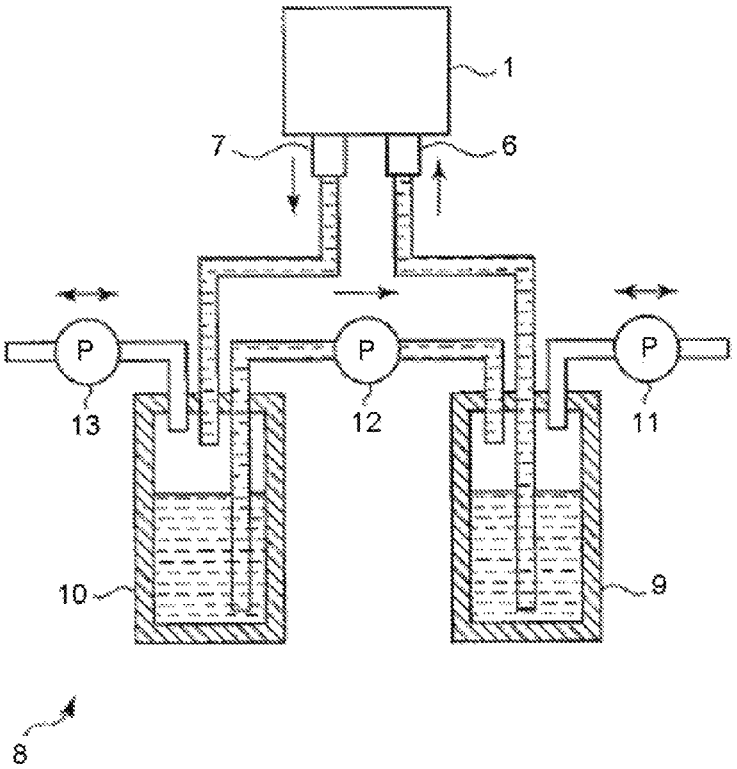
FIG. 2 is a schematic diagram illustrating an ink supply device used in the inkjet recording apparatus according to the embodiment.

FIG. 2 is a schematic diagram illustrating an ink supply device 8 used in the inkjet recording apparatus (an inkjet-system printer) according to the embodiment.

The ink supply device 8 comprises an ink tank 9 at a supply side, an ink tank 10 at a discharging side, a pressure adjusting pump 11 at the supply side, a transfer pump 12 and a pressure adjusting pump 13 at the discharging side, which are connected with each other via tubes through which the ink can flow.

The pressure adjusting pump 11 at the supply side adjusts the pressure of the ink tank 9 at the supply side. The pressure adjusting pump 13 at the discharging side adjusts the pressure of the ink tank 10 at the discharging side. The ink tank 9 at the supply side supplies ink to the ink supply port 6 of the inkjet head 1 through a tube. The ink tank 10 at the discharging side temporarily stores the ink that is discharged from the ink discharging port 7 of the inkjet head 1 through a tube. The transfer pump 12 circulates, through a tube, the ink stored in the ink tank 10 at the discharging side into the ink tank 9 at the supply side.

Next, a structure example of the inkjet head 1 is described below in detail.

Figure 3:
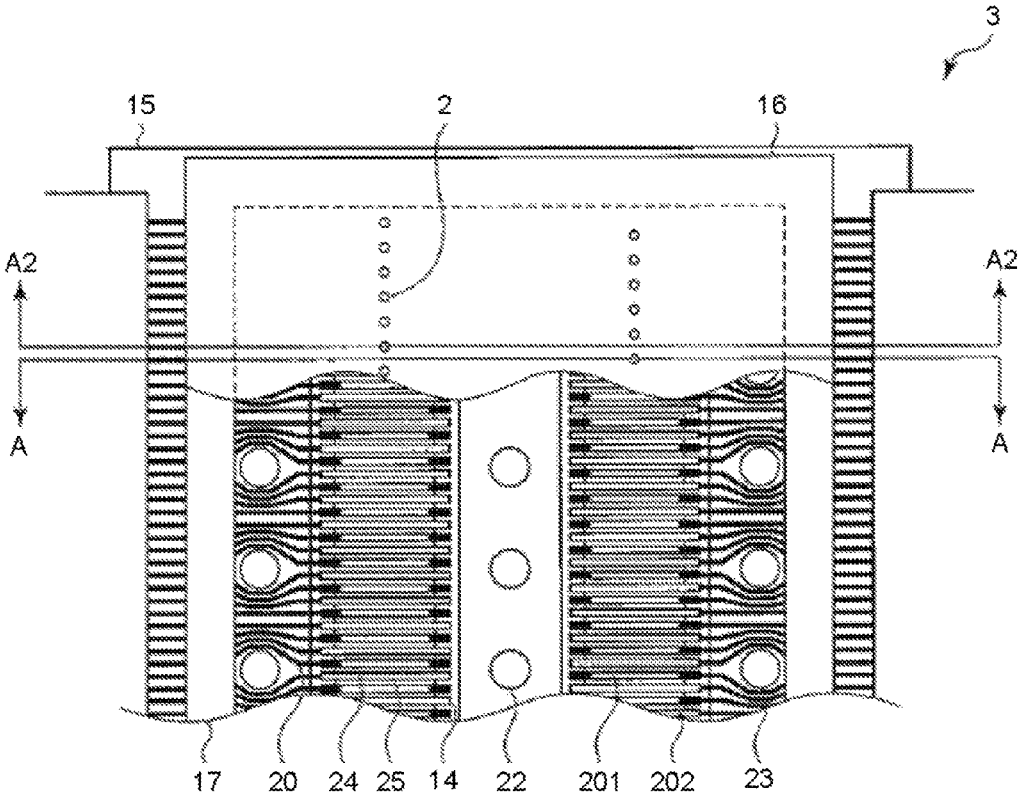
FIG. 3 is a plan view of a head substrate applicable to the inkjet head according to the embodiment.
Figure 4A:
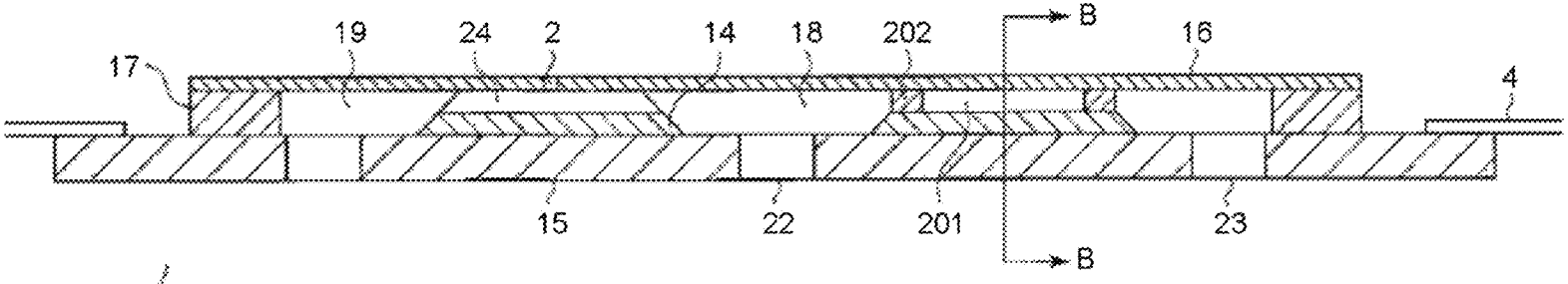
FIG. 4(*a*) is a longitudinal sectional view of a first section of the head substrate.
Figure 4B:
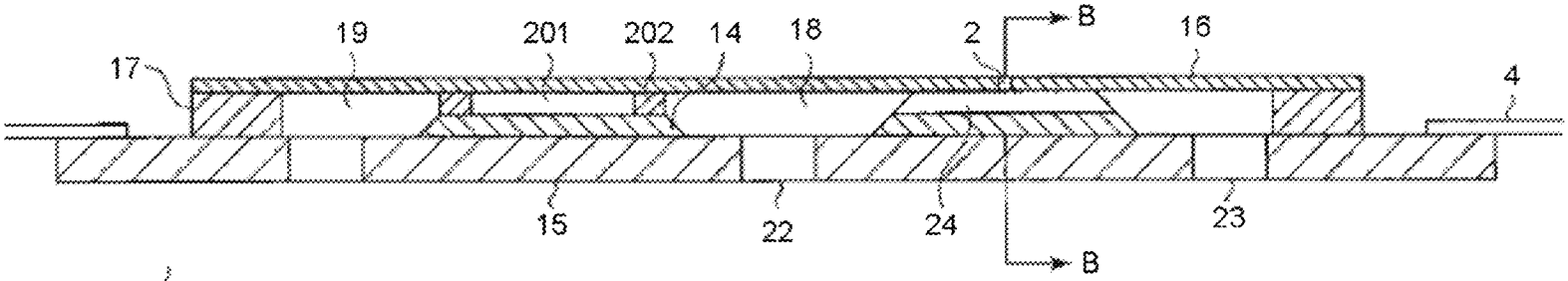
Figure 5A:
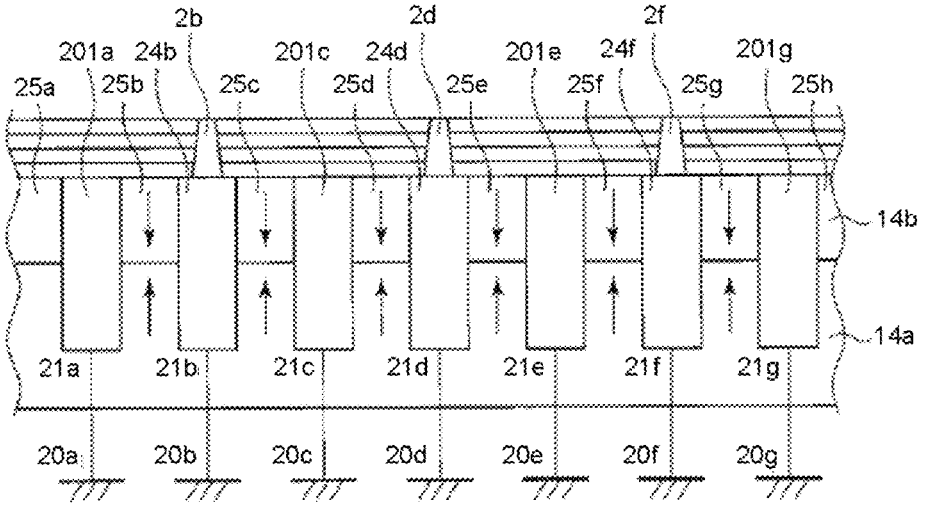
FIG. 5(*a*) is a schematic diagram illustrating a state in which an actuator is not applied with an electric field.
Figure 5B:
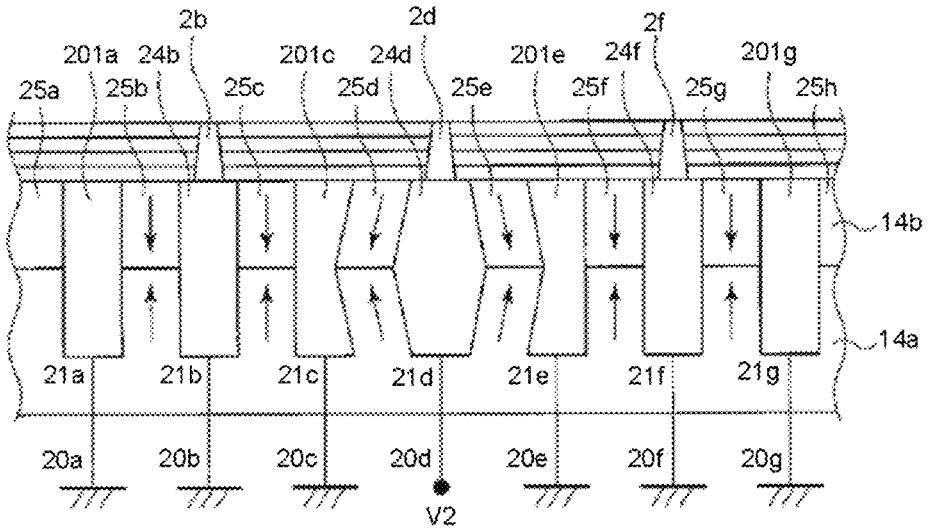

FIG. 3 is a plan view of the head substrate 3 applicable to the inkjet head 1 according to the embodiment. FIG. 4(*a*) is a longitudinal cross-sectional view of the head substrate 3 taken along the line A2-A2 shown in FIG. 3; FIG. 4(*b*) is a longitudinal sectional view of the head substrate 3 taken along the line A-A shown in FIG. 3; FIG. 5(*a*) and FIG. 5(*b*) are cross-sectional views of the head substrates 3 separately taken along the lines B-B shown in FIG. 4(*a*) and FIG. 4(*b*).

As shown in FIG. 3, the head substrate 3 consists of a piezoelectric member 14, a base substrate 15, a nozzle plate 16 and a frame member 17. As shown in FIG. 4(*a*) and FIG. 4(*b*), the central space surrounded by the base substrate 15, the piezoelectric member 14 and the nozzle plate 16 forms an ink supply path 18. Further, the space surrounded by the base substrate 15, the piezoelectric member 14, the frame member 17 and the nozzle plate 16 forms an ink discharging path 19.

The piezoelectric member 14 has a plurality of long grooves passing through the ink supply path 18 and the ink discharging path 19. Pressure chambers 24 and air chambers 201 are alternately formed between the long grooves. The air chamber 201 consists of covers 202 arranged at two ends of the air chamber 201. The cover 202 disenables the flow of the ink in the ink supply path 18 or the ink discharging path 19 into the air chamber 201. The cover 202 is made from, for example, light-cured resin.

Wiring electrodes 20 are formed on the base substrate 15, as shown in FIG. 3. The wiring electrodes 20 are electrically connected with the electrodes 21 formed on the inner surfaces of the pressure chambers 24 and the air chambers 201 and the driver IC 4. Further, an ink supply hole 22 and an ink discharging hole 23 are formed on the base substrate 15. The ink supply hole 22 is connected with the ink supply path 18. The ink discharging hole 23 is connected with the ink discharging path 19. The ink supply hole 22 is fluidically connected with the ink supply port 6 through the manifold 5. The ink discharging hole 23 is fluidically connected with the ink discharging port 7 through the manifold 5. The base substrate 15 is made from, for example, a material which has a small dielectric constant and has a little difference with the piezoelectric member in the thermal expansion coefficient. The material of the base substrate 15 is aluminum oxide (AL2O3), silicon nitride (Si3N4), silicon carbide (SiC), aluminum nitride (AlN), lead zirconate titanate (PZT) or the like. In the present embodiment, the inkjet head 1 of which the base substrate 15 is made from PZT which has low dielectric constant is mainly described.

The piezoelectric member 14 is jointed with and located on the base substrate 15. As shown in FIG. 5, the piezoelectric member 14 is formed by overlapping, along the thickness direction of the substrate, a piezoelectric member 14*a* and a piezoelectric member 14*b* which are polarized in opposite directions. A plurality of long grooves connecting the ink supply path 18 with the ink discharging path 19 are formed on the piezoelectric member 14 in parallel. Each electrode 21 is correspondingly formed on the inner surface of each long groove formed on the piezoelectric member 14. The pressure chamber 24 is a space surrounded by the long grooves and one surface of the nozzle plate 16 covering the long grooves formed on the piezoelectric member 14. The electrode 21 is connected with the driver IC 4 via the wiring electrode 20. The piezoelectric member 14 constituting the next door of the pressure chamber 24 is clamped by the electrodes 21 arranged in the pressure chambers 24, thereby forming the actuator 25.

The driver IC 4 applies an electric field to the actuator 25 according to a drive signal. With the applied electric field, the actuator 25 is deformed into a shape shown in FIG. 5 under a shear strain, with the jointed part of the piezoelectric members 14*a* and 14*b* as its top. The volume of the pressure chamber 24 is changed due to the deformation of the actuator 25. The ink in the pressure chamber 24 is pressurized if the volume of the pressure chamber 24 is changed. The pressurized ink is ejected from the nozzle 2. The piezoelectric member 14 is made from lead zirconate titanate (PZT: Pb (Zr, Ti) O3), lithium niobate (LiNbO3), lithium tantalite (LiTaO3) or the like. In the present embodiment, it is assumed that the piezoelectric member 14 is made from lead zirconate titanate (PZT) which is high in piezoelectric constant.

The electrode 21 has a structure of double-layer consisting of nickel (Ni) and aurum (Au). For example, the electrode 21 is formed uniformly in the long groove using an electrochemical plating method. In addition to an electrochemical plating method, a sputtering method or a vapor plating method may also be used to form the electrode 21.

For example, the long grooves each with a depth of 300.0 μm and a width of 80.0 μm are arranged at intervals of 169.0 μm in parallel.

The long grooves form the pressure chamber 24 and the air chamber 201. The pressure chamber 24 and the air chamber 201 are formed alternately and parallelly.

The nozzle plate 16 is bonded on the piezoelectric member 14. On the nozzle plate 16, the nozzle 2 is formed in the lengthwise center of the pressure chamber 24. The nozzle plate 16 is made from a metal material such as stainless steel, an inorganic material such as monocrystalline silicon or a resin material such as polyimide film. Further, in the present embodiment, it is assumed that the material of the nozzle plate 16 is mainly polyimide film.

For example, the nozzle 2 is formed by machining holes on the nozzle plate 16 with an excimer laser after the nozzle plate 16 is bonded with piezoelectric member 14. The nozzle 2 is a tapering shape from the pressure chamber 24 towards an ink ejection side. In a case where the nozzle plate 16 is made from stainless steel, the nozzle 2 can be shaped through pressure forming. Further, in a case where the material of the nozzle plate 16 is monocrystalline silicon, the nozzle 2 is formed with a dry or wet etching method based on a photolithography method.

The inkjet head described above is structured with the ink supply path 18 on one end of the pressure chamber 24, the ink discharging path 19 on the other end of the pressure chamber 24 and the nozzle 2 in the center of the pressure chamber 24. The structure of an inkjet head applicable to the inkjet recording apparatus according to the present embodiment is not limited to the foregoing example. For example, an inkjet head having a nozzle on one end of the pressure chamber 24 and an ink supply path on the other end of the pressure chamber 24 is also applicable to the inkjet recording apparatus according to the present embodiment.

Next, the operation principle of the inkjet head according to the present embodiment is described below.

FIG. 5(*a*) shows a state in which a ground voltage is applied to all electrodes 21*a*-21*g* through wiring electrodes 20*a*-20*g*. In FIG. 5(*a*), each electrode has the same potential, thus, no electric field is applied to the actuators 25*a*-25*h*, and the actuators 25*a*-25*h* are not deformed. FIG. 5(*b*) shows a state in which a voltage V2 is only applied to the electrode 21*d*. In the state shown in FIG. 5(*b*), potential differences are separately generated between the electrode 21*d* and the electrodes 21*c* and 21*e* adjacent to the electrode 21*d*. Due to the potential differences, the actuators 25*d* and 25*e* are deformed into a shape shown in FIG. 5(*b*) so as to increase the volume of the pressure chamber 24*d*. If the voltage of the electrode 21*d* returns to the ground voltage, the actuators 25*d* and 25*e* return from the state shown in FIG. 5(*b*) to the state shown in FIG. 5(*a*), thus ink droplets are ejected from the nozzle 2*d*.

Figure 6A:
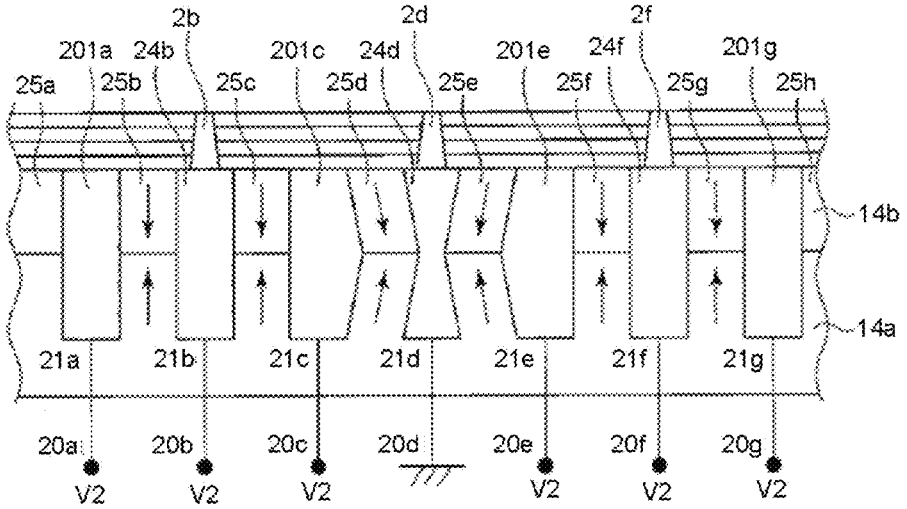
FIG. 6(*a*) and FIG. 6(*b*) are schematic diagrams illustrating a state in which the volume of the pressure chamber is decreased.
Figure 6B:
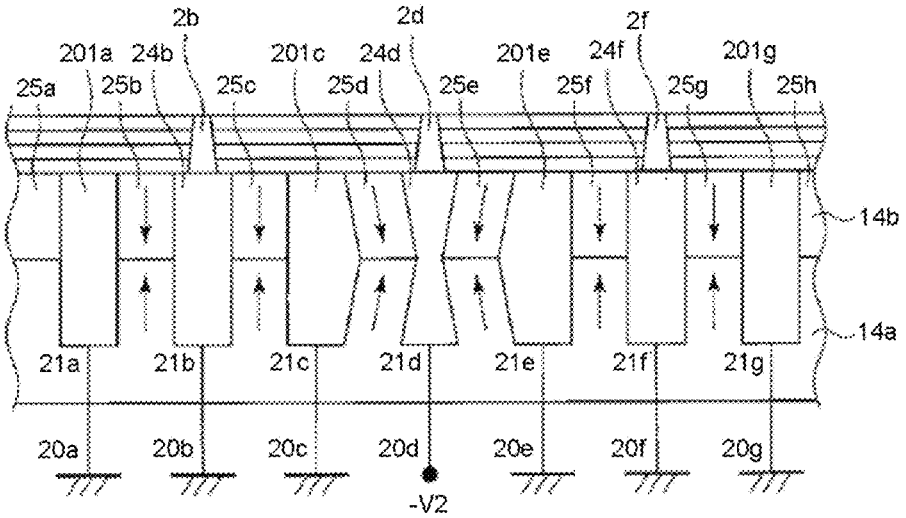

FIG. 6(*a*) and FIG. 6(*b*) are cross-sectional views taken along the lines B-B shown in the head substrates 3 shown in FIG. 4(*a*) and FIG. 4(*b*). FIG. 6(*a*) and FIG. 6(*b*) show a state in which the volume of the pressure chamber 24 is decreased. FIG. 6(*a*) and FIG. 6(*b*) show a state in which the actuators 25*d* and 25*e* are deformed into a shape reverse to that shown in FIG. 5(*b*).

FIG. 6(*a*) shows a state in which the voltage of the electrode 21*d* is set to the ground voltage and the voltage V2 is applied to the electrodes 21*a*, 21*c*, 21*e* and 21*g* of the air chambers 201*a*, 201*c*, 201*e* and 201*g*. In the state shown in FIG. 6(*a*), potential differences reverse to that shown in FIG. 5(*b*) are separately generated between the electrode 21*d* and the electrodes 21*c* and 21*e* adjacent to the electrode 21*d*. Due to the potential differences, the actuators 25*d* and 25*e* are deformed into a shape shown in FIG. 6(*a*) reverse to that shown in FIG. 5(*b*). Further, FIG. 6(*a*) shows a state in which the voltage V2 is also applied to the electrodes 21*b* and 21*f*. In this way, the actuators 25*b*, 25*c*, 25*f* and 25*g* are not deformed. If the actuators 25*b*, 25*c*, 25*f* and 25*g* are not deformed, the pressure chambers 24*b* and 24*f* are not contracted.

FIG. 6(*b*) shows a state in which the voltage of the electrode 21*d* is set to −V2 and those of the other electrodes 21*a*, 21*b*, 21*c*, 21*e*, 21*f* and 21*g* are set to a ground voltage. In the state shown in FIG. 6(*b*), potential differences reverse to those shown in FIG. 5(*b*) are separately generated between the electrode 21*d* and the electrodes 21*c* and 21*e* adjacent to the electrode 21*d*. Due to the potential differences, the actuators 25*d* and 25*e* are deformed into a shape shown in FIG. 6(*b*) reverse to that shown in FIG. 5(*b*).

Figure 7:
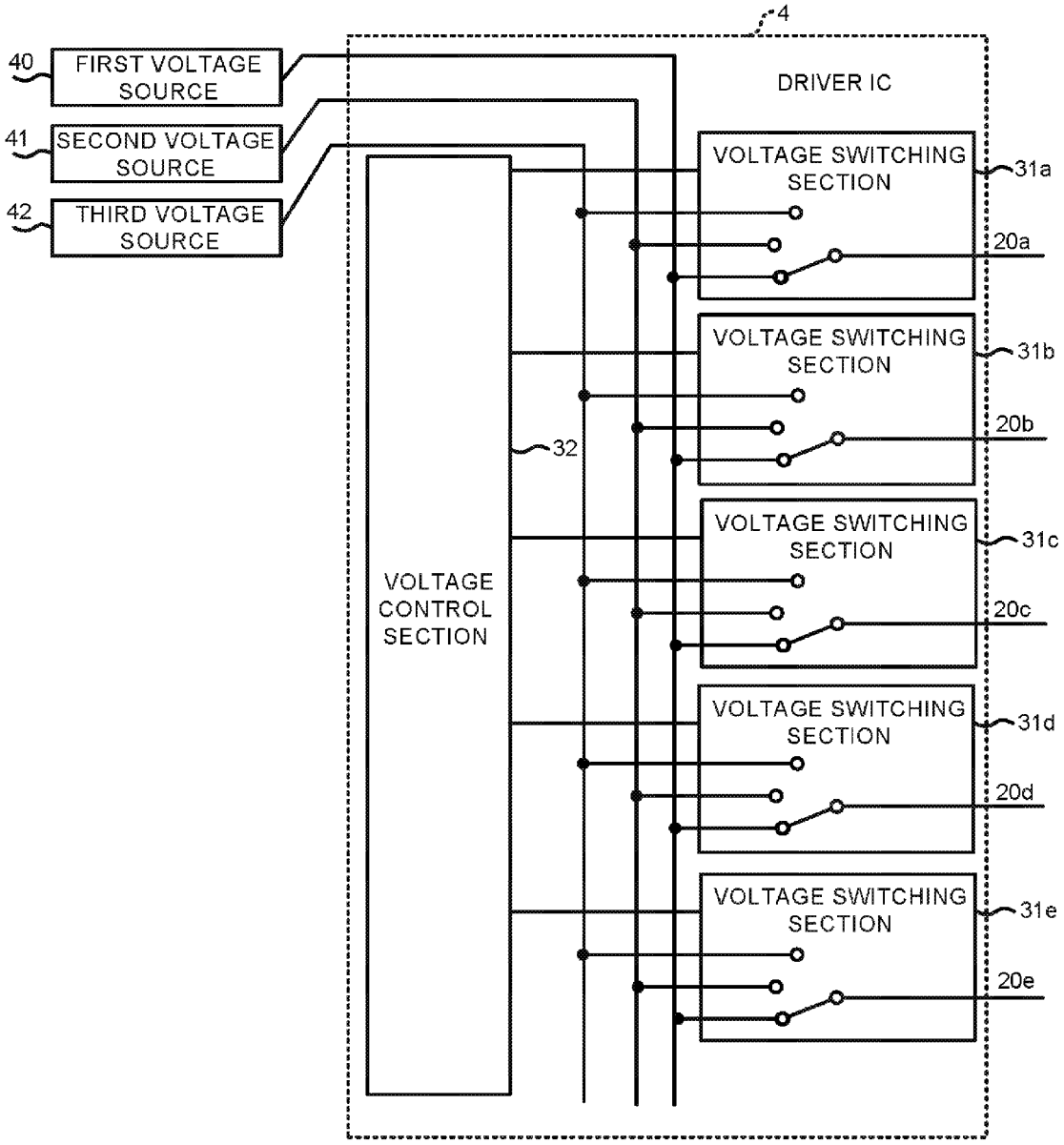
FIG. 7 is a diagram illustrating a first structure example of a driver IC.

FIG. 7 is a diagram illustrating a structure example (a first structure example) of the driver IC 4.

In the structure example shown in FIG. 7, the driver IC 4 includes a voltage switching section 31 (31*a*, 31*b* . . . 31*e*) and a voltage control section 32.

The driver IC 4 is connected with voltage sources 40, 41 and 42. The voltage sources 40, 41 and 42 selectively apply a voltage to each wiring electrode 20. In the example shown in FIG. 7, the voltage source 40 is set as a ground voltage of which a voltage value is V0 (V0=0[V]). Further, the voltage value V1 of the voltage source 41 is set to be higher than the voltage value V0, and the voltage value V2 of the voltage source 42 is set to be higher than the voltage value V1.

The voltage switching sections 31*a*, 31*b* . . . 31*e* are connected with the wiring electrodes 20*a*, 20*b* . . . 20*e*, respectively. Further, each voltage switching section 31 is connected with each of the voltage sources 40, 41 and 42 through wires drawn into the inside of the driver IC 4. The voltage switching section 31 has a changeover switch for switching the voltage source connected with the wiring electrode 20. For example, the voltage switching section 31*a* connects any one of the voltage sources 40, 41 and 42 with the wiring electrode 20*a* via the changeover switch.

The voltage control section 32 is connected with the voltage switching sections 31*a*, 31*b* . . . 31*e*, respectively. The voltage control section 32 outputs a command indicating which one of the first to the third voltage sources 40, 41 and 42 is selected to each voltage switching section 31. For example, the voltage control section 32 receives printing data from the outside of the driver IC 4 and determines the timing of the switching of the voltage source in each voltage switching section 31. The voltage control section 32 outputs the command indicating which one of the first to the third voltage sources 40, 41 and 42 is selected to each voltage switching section 31 at the determined switching timing. In this way, each voltage switching section 31 switches the voltage sources connected with the wiring electrodes 20 according to the command from the voltage control section 32.

Figure 8A:
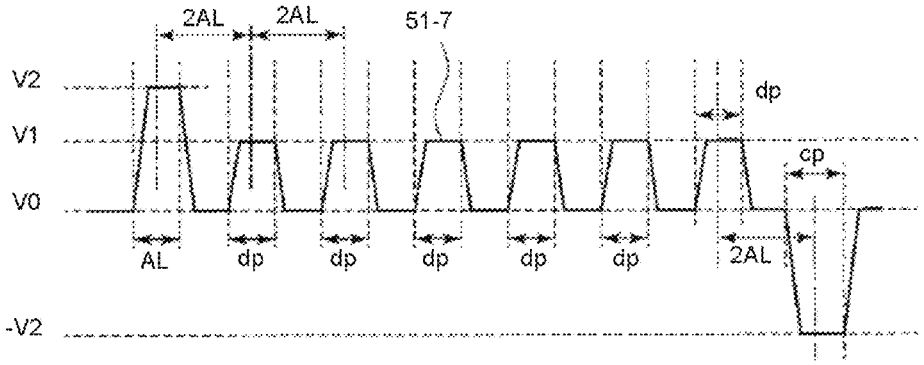
FIG. 8(*a*) exemplifies a driving waveform in a case of the continuous ejection of seven ink droplets.
Figure 8B:
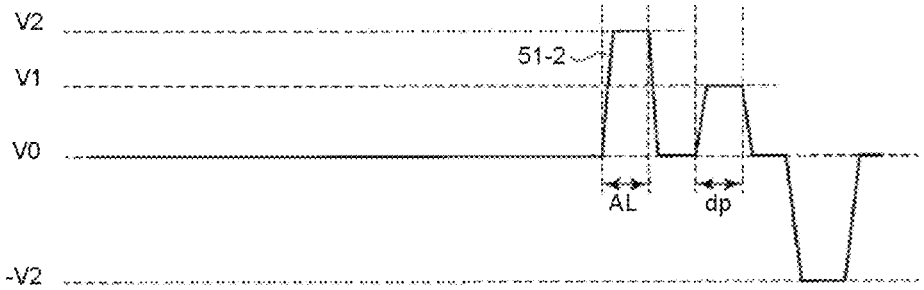
Figure 8C:
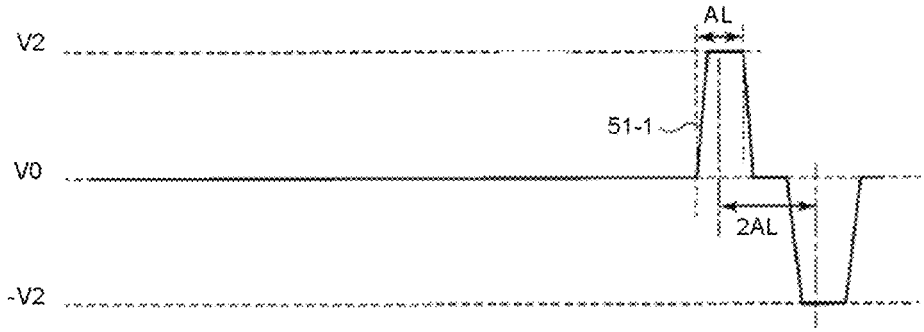

FIG. 8(*a*)-FIG. 8(*c*) are diagrams exemplifying driving waveforms 51 (51-7, 51-2 and 51-1) applied to the electrode 21.

In FIG. 8(*a*)-FIG. 8(*c*), the horizontal axis indicates time and the vertical axis indicates a potential difference. The potential differences shown in FIG. 8(*a*)-FIG. 8(*c*) are potential differences with the wiring electrodes 20 that are connected with the electrodes on the inner walls of two adjacent air chambers 201. For example, it is assumed that the driving waveform is applied to the electrode 21*d* shown in FIG. 5(*a*). In this case, the two adjacent air chambers refer to the air chambers 201*c* and 201*e*. Further, the electrodes on the inner walls of the two adjacent air chambers 201*c* and 201*e* refer to the electrodes 21*c* and 21*e*, and the wiring electrodes connected with the electrodes 21*c* and 21*e* refer to the wiring electrodes 20*c* and 20*e*. That is, if the electrode applied with the driving waveform is the electrode 21*d*, the potential differences shown in FIG. 8(*a*)-FIG. 8(*c*) indicate the potential differences between the electrode 21*d* and the wiring electrodes 20*c* and 20*e* (the potential differences between the electrode 21*d* and the electrodes 21*c* and 21*e*).

FIG. 8(*a*) exemplifies the driving waveform 51-7 in a case of the continuous ejection of seven ink droplets. If the driving waveform 51-7 is applied to the electrode 21*d*, the pressure chamber 24*d* is in the state shown in FIG. 5(*a*), that is, the volume of the pressure chamber 24*d* is not changed, when the potential difference of the driving waveform 51-7 is 0. The pressure chamber 24*d* is in the state shown in FIG. 5(*b*), that is, the volume of the pressure chamber 24*d* is increased, when the potential difference of the driving waveform 51-7 applied to the electrode 21*d* is V2. The pressure chamber 24*d* is in the state shown in FIG. 6(*a*), that is, the volume of the pressure chamber 24*d* is decreased, when the potential difference of the driving waveform 51-7 applied to the electrode 21*d* is −V2.

Figure 9:
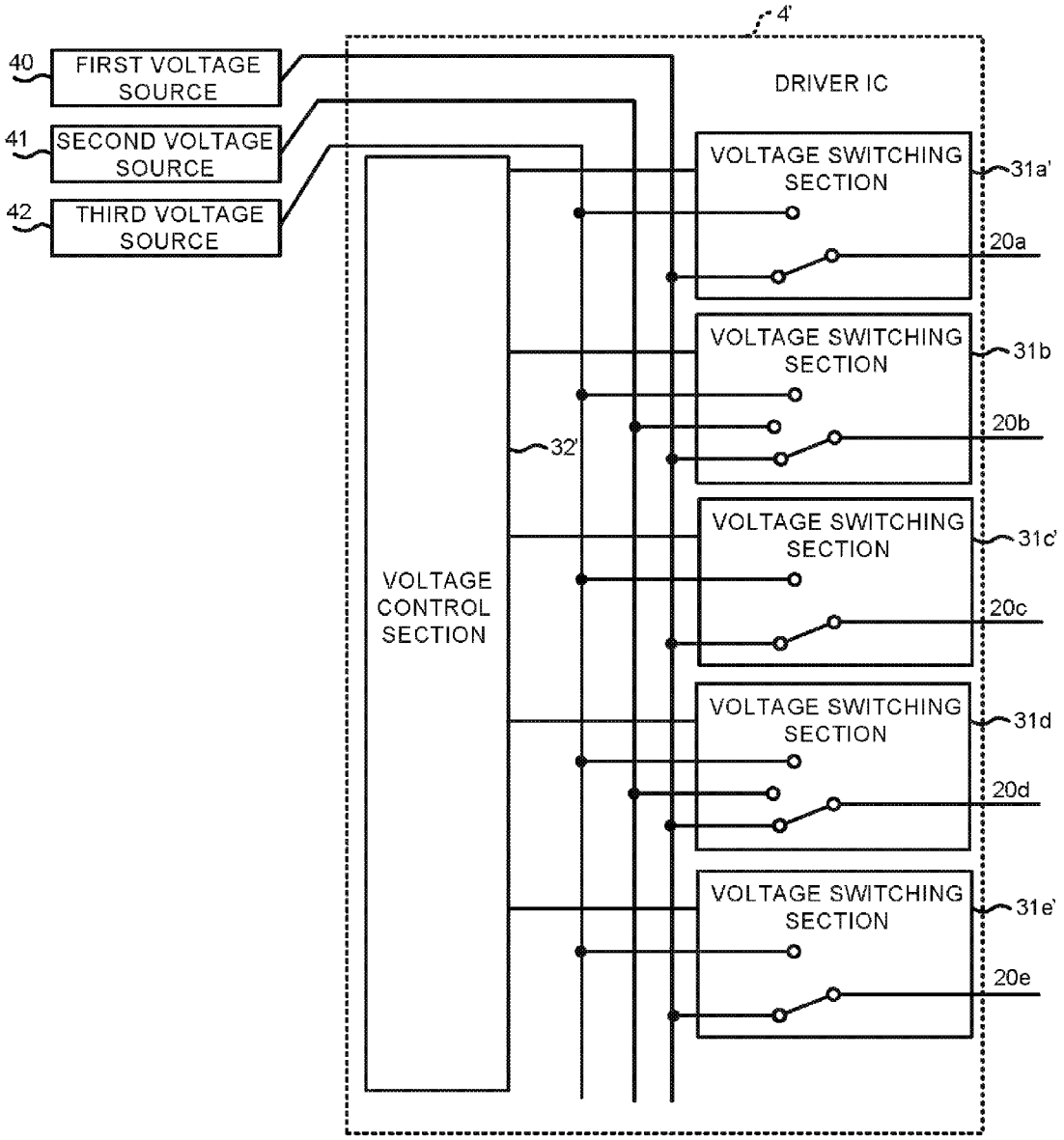
FIG. 9 is a diagram illustrating a second structure example of the driver IC.

FIG. 9 is a diagram illustrating a modification (a second structure example) of the driver IC 4. FIG. 9 shows a structure example of a driver IC 4' in the absence of a maintained potential difference −V1. If it is not needed to maintain a potential difference −V1 in the driving waveform, then it is not necessary for the voltage switching section to connect the electrode on the inner wall of the air chamber with the voltage source of which a voltage value is V1. In the second structure example shown in FIG. 9, in the driver IC 4°, voltage switching sections 31*a*', 31*c*' and 31*e*' is connected with the electrodes on the inner walls of the air chambers and the wiring electrodes.

The driving waveform 51-7 shown in FIG. 8(*a*) consists of seven ejection pulses. It is set that the initial ejection pulse is a first ejection pulse and a second ejection pulse and pulses thereafter are a second ejection pulse. The voltage amplitude of the first ejection pulse is a potential difference V2 serving as a first voltage amplitude. The voltage amplitude of the second ejection pulse is a potential difference V1 serving as a second voltage amplitude smaller than the first voltage amplitude. There is a residual pressure vibration in the pressure chamber applied with the driving waveform if an ink droplet is ejected with the first ejection pulse. The second ejection pulse is applied at the timing when the residual pressure vibration resulting from the former ejection pulse and the next ejection pulse are intensified mutually.

Further, there is a residual pressure vibration in the pressure chamber even after the ejection of an ink droplet with the last ejection pulse. The residual pressure vibration caused by the last ejection pulse affects the ejection of the next ink droplet based on the next driving waveform. Thus, the residual pressure vibration is necessarily eliminated in advance prior to the start of the ejection of the next ink droplet based on the next driving waveform. For example, the residual pressure vibration is eliminated by being applied with a cancellation pulse (flow-in and flow-out suppression pulse). The cancellation pulse (flow-in and flow-out suppression pulse) suppresses the flow of ink into or out from the nozzle and the pressure chamber. The last trapezoidal wave included in the driving waveform 51-7 shown in FIG. 8(*a*) is a cancellation pulse with a potential difference of −V2 which serves as a third voltage amplitude. The cancellation pulse is applied at a residual pressure vibration cancellation timing.

The inkjet recording apparatus according to the present embodiment unites continuously ejected ink droplets (seven ink droplets in the case of the driving waveform 51-7) so as to impact an object with a big ink droplet. For example, the driving waveform 51-7 makes seven ink droplets continuously ejected so as to impact an object with an ink corresponding to the amount of the seven ink droplets. That is, the inkjet recording apparatus according to the present embodiment changes the size of an ink droplet impacting an object by changing the number of the second ejection pulses included in the driving waveform. For example, the inkjet recording apparatus according to the present embodiment sets that at most seven ink droplets can be ejected continuously. In this case, if the absence of the ejection of an ink droplet (the number of ink droplets: 0) is taken into account, then the number of the gradations of the ink droplet amount is eight gradations.

Further, the inkjet recording apparatus according to the present embodiment carries out a control processing to integrate the ink droplets ejected continuously while the ink droplets are flying. To integrate the ink droplets ejected continuously while the ink droplets are flying, the last ink droplet ejected continuously is necessarily ejected at a higher speed than the initial ink droplet. The inkjet recording apparatus according to the present embodiment sets the first voltage amplitude V2 and the second voltage amplitude V1 in a driving waveform so that the last ink droplet is ejected at a higher speed than the initial ink droplet.

Hereinafter, an example of the setting of the first and the second voltage amplitudes (potential differences V2 and V1) in a driving waveform for ejecting ink is described.

FIG. 8(*b*) exemplifies the driving waveform 51-2 in a case of the ejection of two ink droplets, and FIG. 8(*c*) exemplifies the driving waveform 51-1 in a case of the ejection of one ink droplet. It is assumed that in FIG. 8(*a*)-FIG. 8(*c*), the potential difference (the first voltage amplitude) of the first ejection pulse is 25V and that (the third voltage amplitude) of the cancellation pulse is −25V. The pulse width of the first/second ejection pulse is the sum of the time when the waveform rises from a reference potential V0 to the potential difference of the first/second ejection pulse and the time when the raised potential difference is maintained. Further, the pulse width of the cancellation pulse is the sum of the time when the waveform falls from the reference potential V0 to the potential difference of the cancellation pulse and the time when the dropped potential difference is maintained.

The second ejection pulse makes ink droplets continuously ejected at a residual pressure vibration timing. If ½ (half cycle) of the acoustic resonance cycle of the ink in the pressure chamber 24 is set to be 'AL', then each interval between the ejection pulses is set according to 'AL'. In the examples shown in FIG. 8(*a*)-FIG. 8(*c*), the pulse width of the first ejection pulse is 1AL, and each interval between successive ejection pulses is the interval between centers of successive pulse widths, that is, 2AL.

In the inkjet recording apparatus according to the present embodiment, the potential difference V1 based on the second ejection pulse is set to be smaller than the potential difference V2 based on the first ejection pulse. The power consumption in the head drive occurs in the movement of charges caused by the application of a voltage to each electrode. Thus, less power is consumed in a case where the potential difference V1 of the second ejection pulse is smaller than the potential difference V2 of the first ejection pulse than that consumed in a case where the potential difference V1 of the second ejection pulse is equal to the potential difference V2 of the first ejection pulse.

Hereinafter, an example of the setting of the potential difference (the second voltage amplitude) V1 of the second ejection pulse in a case where the pulse width dp of the second ejection pulse is set to be AL is described.

In the following description, it is assumed that the AL of the pressure chamber 24 is nearly 2.2 μs, the rise time and the fall time of each pulse are about 0.2 μs, and the pulse width cp of the cancellation pulse is 3.4 μs. Further, the rise/fall time of each pulse, which relates to the time constant of the whole circuit in a case in which the actuator is regarded as a condenser and the internal resistance and the wiring resistance of the driver IC are taken into consideration, indicates a charging/discharging time needed for changing the potential difference inside the condenser when the voltage source connected with the condenser is changed.

Next, the relationship between the potential difference (the second voltage amplitude) of the second ejection pulse and the speed of an ink droplet is described below.

Figures 10, 11:
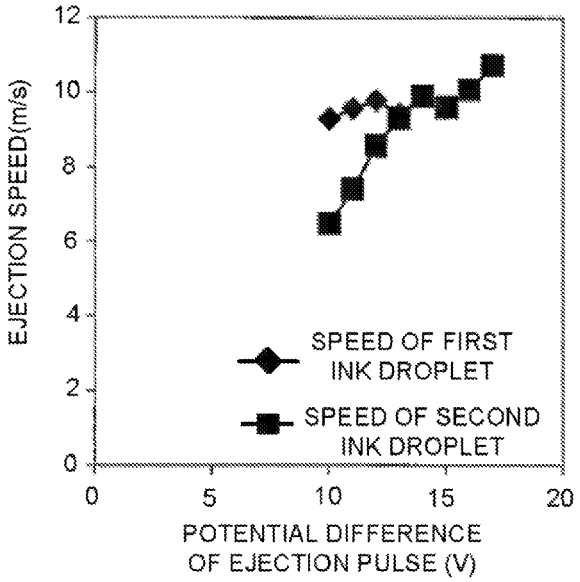
FIG. 10 is a diagram illustrating a simulation result of speeds of ink droplets ejected when potential difference of a second ejection pulse is changed.
FIG. 11 is a diagram illustrating the graphed simulation result shown in FIG. 10.

FIG. 10 is a diagram illustrating a simulation result of speeds of ink droplets ejected when the potential difference of the second ejection pulse is changed. FIG. 11 is a diagram illustrating the graphed simulation result shown in FIG. 10.

FIG. 10 shows the result of a simulation based on numerical analysis. In the simulation shown in FIG. 10, a displacement occurring in the actuator is calculated first with a structural analysis. After the displacement of the actuator is received, the flow of the fluid in the pressure chamber is calculated with a compressible fluid analysis. The behavior of an ink droplet ejected from the nozzle is calculated with a superficial fluid analysis. The structural analysis is conducted in a range which covers the piezoelectric member 14 and the nozzle plate 16 that form the pressure chamber 24 together in the vertical direction shown in FIG. 4(*a*) or FIG. 4(*b*), the horizontal direction shown in FIG. 4(*a*) or FIG. 4(*b*) is a range containing the piezoelectric member 14, the vertical direction shown in FIG. 3 (the depth direction shown in FIG. 4) is set as a range from the line A to the line A2, and the boundary surface that takes the vertical direction shown in FIG. 3 as a normal vector is set as a symmetry boundary.

The compressible fluid analysis is conducted in a range covering the pressure chambers, and the boundaries between the ink supply path or the ink discharging path and the pressure chamber are set as a free flow condition. On the condition that the pressure value of the vicinity of the nozzle in the pressure chamber is an input condition for the superficial fluid analysis for analyzing the fluid surface of the nozzle, as a result, in the superficial fluid analysis, the flow rate of the ink flowing into the nozzle from the pressure chamber is input to the compressible fluid analysis as the outflow rate of the ink nearby the nozzle in the pressure chamber, thereby conducting a coupled analysis.

FIG. 10 shows the ejection speeds of a first ink droplet ejected with the first ejection pulse and a second ink droplet ejected with the second ejection pulse. For example, FIG. 10 shows the speeds of ink droplets ejected with the driving waveform 51-2 shown in FIG. 8(*b*) which includes one first ejection pulse and one second ejection pulse.

According to the result of the simulation shown in FIG. 10, the speed difference between the first ink droplet and the second ink droplet decreases as the potential difference V1 increases. When the potential difference V1 is equal to or greater than 14V, the speeds of the first and the second ink droplets are equal, which indicates that the first ink droplet and the second ink droplet are integrated into one droplet. That is, to integrate the first ink droplet and the second ink droplet, the voltage amplitude V1 of the second ejection pulse needs to be equal to or greater than 14V if the voltage amplitude V2 of the first ejection pulse is 25V. The potential difference V1 is desired to be above 14V if the different manufacture methods of inkjet heads is taken into consideration.

Further, the ejection speed of the second ink droplet is increased if the potential difference V1 increases; however, the ejection speed of the second ink droplet can also be reduced by making the pulse width dp of the second ejection pulse smaller (or greater) than AL. Thus, the ejection speed of the second ink droplet can be adjusted by adjusting the pulse width dp of the second ejection pulse. Moreover, the pulse width dp of the second ejection pulse may be adjusted for each pressure chamber, matching with the difference in different manufacture method. For example, the pressure chamber which ejects the second ink droplet at a small speed can increase the ejection speed of the second ink droplet by making the pulse width dp of the second ejection pulse close to AL. Further, the pressure chamber which ejects the second ink droplet at a high speed can decrease the ejection speed of the second ink droplet by making the pulse width dp of the second ejection pulse greatly different from AL.

Next, the relationship between the ejection speed and the ejection volume for the number of the continuously ejected ink droplets is described below.

Figures 12, 13:
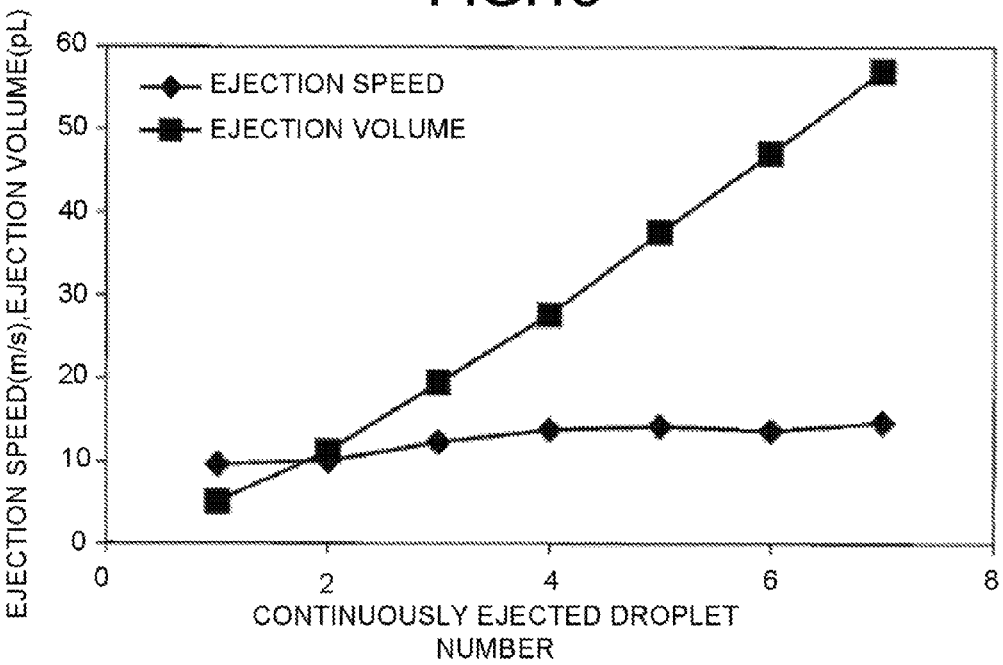
FIG. 12 is a diagram illustrating the result of a simulation on the ejection speed and the ejection volume for the number of droplets that are continuously ejected.
FIG. 13 is a diagram illustrating the graphed simulation result shown in FIG. 12.

FIG. 12 is a diagram illustrating the result of a simulation on the ejection speed and the ejection volume for the number of ink droplets that are continuously ejected. FIG. 13 is a diagram illustrating the graphed simulation result shown in FIG. 12. Further, the simulation result shown FIG. 12 indicates the ejection speed and the ejection volume of a case in which the number of ink droplets that are continuously ejected is from 1 to 7 when the pulse width of the second ejection pulse is specific. Further, in FIG. 12, the potential difference V2 of the first ejection pulse is 25V, the potential difference V1 of the second ejection pulse is 16V, and the pulse widths of the first and the second ejection pulses are both AL. Further, the potential difference and the pulse width of the cancellation pulse are −25V and 3.4 μs.

In the examples shown in FIG. 12 and FIG. 13, the ejection speed after the integration of the ink droplets in a case in which the number of ink droplets continuously ejected is seven is about 1.5 times as fast as that in a case in which the number of ink droplets continuously ejected is one. That is, if the pulse width of the second ejection pulse is set to be specific, then the ink droplet resulting from the integration of seven ink droplets is 1.5 times as fast as that of the first ink droplet, which means that if the pulse width is specific, then, the more the number of the ink droplets ejected continuously are, the more significantly the speed of the ink droplet is changed. Further, the volume of the ink droplet ejected, with respect to the number of the ink droplets, is not increased in a full proportion but increased slightly in accordance with an exponential function, which indicates that the more the ink droplets ejected are, the larger the residual vibration generated on the surface of the nozzle and the pressure chamber is. As a result, the effect on the ejection speed and the ejection volume of ink droplets that ejected in the second half is larger compared with ink droplets that ejected in the first half among the continuously ejected ink droplets.

Figure 14A:
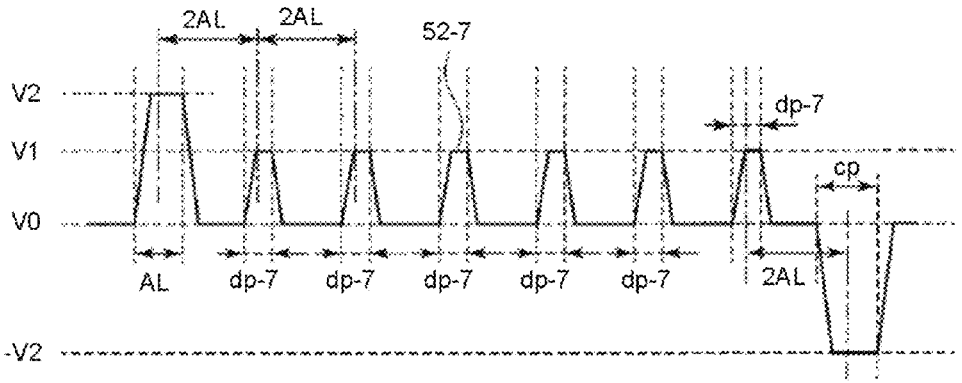
FIG. 14(*a*) exemplifies a driving waveform in a case of the continuous ejection of seven ink droplets.
Figure 14B:
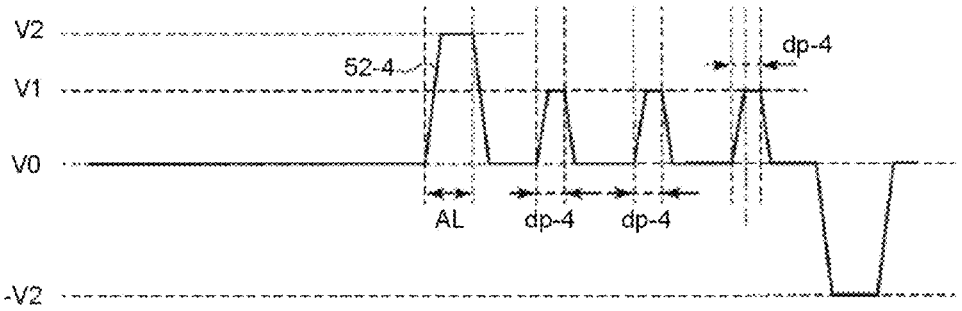
Figure 14C:
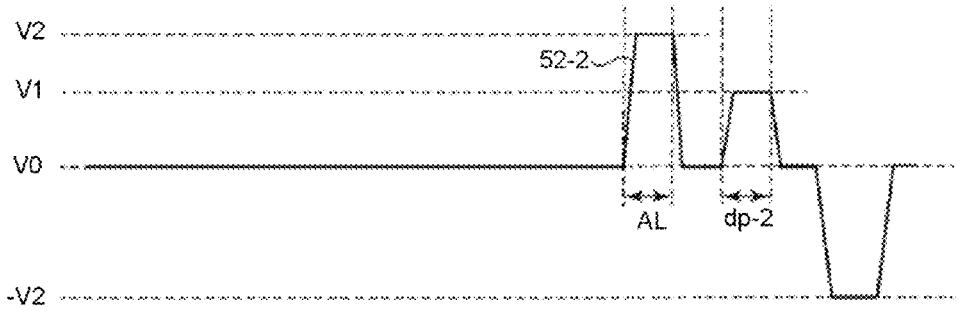

FIG. 14(*a*)-FIG. 14(*c*) show examples of a driving waveform including a second ejection pulse the pulse width of which is changed according to the number of continuously ejected ink droplets. FIG. 14(*a*) exemplifies the driving waveform 52-7 in a case of continuous ejection of seven ink droplets. FIG. 14(*b*) exemplifies the driving waveform 52-4 in a case of continuous ejection of four ink droplets. FIG. 14(*c*) exemplifies the driving waveform 52-2 in a case of continuous ejection of two ink droplets.

Figures 15, 16:
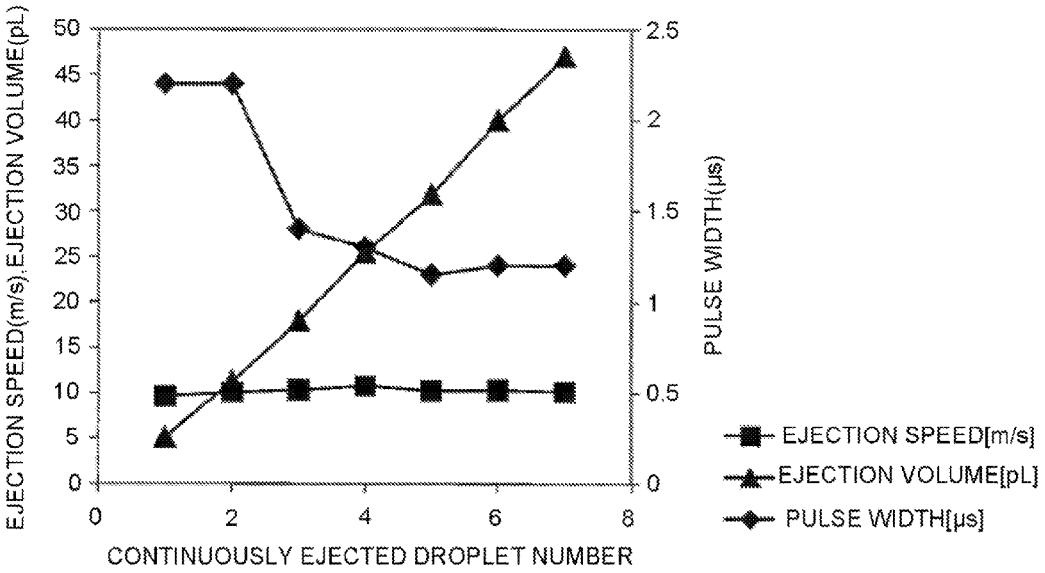
FIG. 15 is a diagram illustrating the result of a simulation on the ejection speed and the ejection volume for the number of ink droplets that are continuously ejected when a pulse width of a second ejection pulse is changed.
FIG. 16 is a diagram illustrating the graphed simulation result shown in FIG. 15.

FIG. 15 is a diagram illustrating the result of a simulation on the ejection speed and the ejection volume with respect to the number of the ink droplets continuously ejected when the pulse width of the second ejection pulse is changed. FIG. 16 is a diagram illustrating the graphed simulation result shown in FIG. 15.

The pulse width of the second ejection pulse corresponding to a droplet number '2' (the second ink droplet) is equal to that shown in FIG. 15 and that shown in FIG. 12 (AL=2.2 μs). Thus, the driving waveform 51-2 shown in FIG. 8(*b*) is identical to the driving waveform 52-2 shown in FIG. 14(*c*). Further, the ejection speed and the ejection volume of the droplet number '2' (the second ink droplet) shown in FIG. 15 are the same as that shown in FIG. 12.

Herein, the pulse width of the second ejection pulse shown in FIG. 15 corresponding to droplet numbers '3'-'7' (the third to the seventh ink droplet) is smaller than that (AL=2.2 μs) shown in FIG. 12. For example, the ink droplets separately formed by the integration of the third to the seventh ink droplets are substantially ejected at the same speed. For example, the integration of the third to the seventh ink droplets is ejected at a speed of about 10 m/s, and the ejection volume is a value close to a proportion to the number of the ink drops. According to FIG. 15 and FIG. 16, by changing the pulse width of each second ejection pulse for ejecting the third to the seventh ink droplets, the ejection speeds of integration of the ink droplets in a case in which the number of the ink droplets are 3-7 are controlled to be close to a specific value.

As stated above, the more the continuously ejected ink droplets are, the larger the residual vibration generated on the surface of the nozzle and the pressure chamber is. It can be controlled that the ejection speed of an ink droplet formed by the integration of the continuously ejected ink droplets is specific regardless of the number of the ink droplets through changing the pulse width of the second ejection pulse according to the number of the ink droplets that are continuously ejected. Further, it can be controlled that the ejection volume is in proportion to the number of the ink droplets through changing the pulse width of the second ejection pulse according to the number of the ink droplets that are continuously ejected.

In the foregoing examples, if the potential difference of the second ejection pulse is equal to or greater than 14V, it is possible that the ejection speed of the last ejected ink droplet is greater than that of the ink droplet ejected initially. The power consumption in the head drive occurs in the movement of charges caused by the application of a voltage to each electrode. In the present embodiment, less electric power can be consumed in a case where the potential difference V1 of the second ejection pulse is smaller than the potential difference V2 of the first ejection pulse than that consumed in a case where the potential difference V1 of the second ejection pulse is equal to the potential difference V2 of the first ejection pulse.

Next, the cancellation pulse is described below.

Figure 17A:
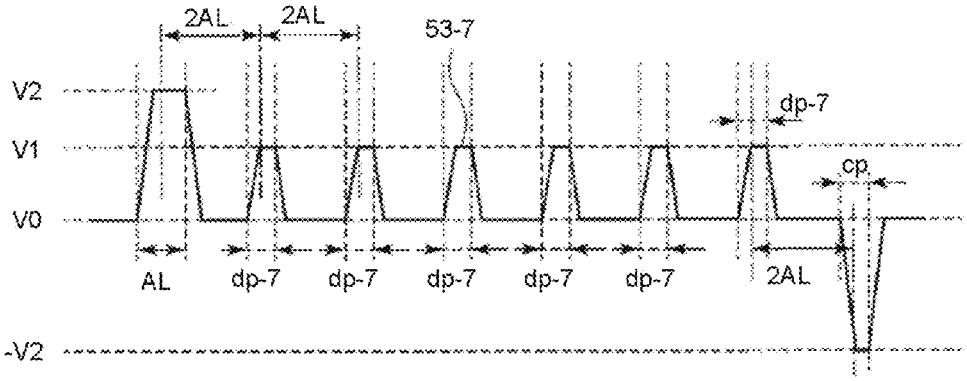
FIG. 17(*a*)-FIG. 17(*c*) are diagrams respectively exemplifying driving waveforms pulse widths of cancellation pulses of which become small values included in the driving waveforms shown in FIG. 14(*a*)-FIG. 14(*c*)
Figure 17B:
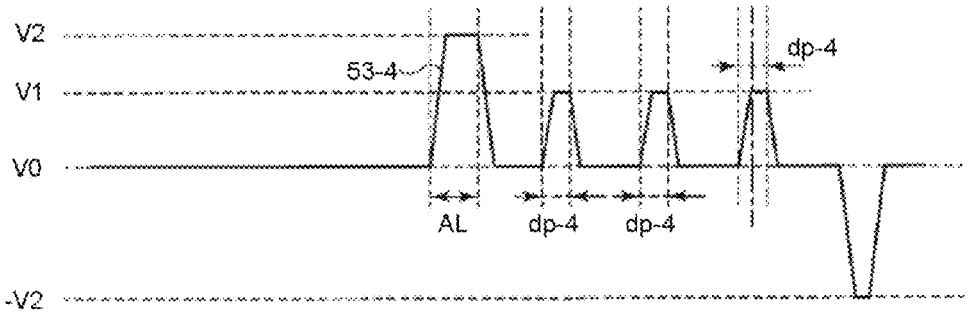
Figure 17C:
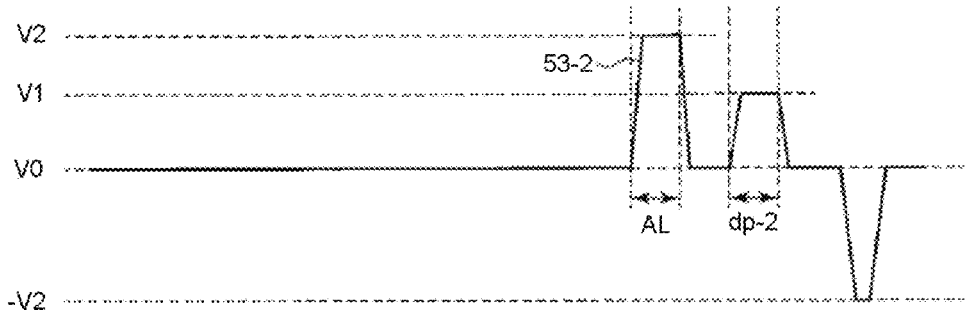

FIG. 17(*a*)-FIG. 17(*c*) are diagrams separately illustrating driving waveforms 53-7, 53-4 and 53-2 obtained by reducing the pulse widths of the cancellation pulses included in the driving waveforms shown in FIG. 14(*a*)-FIG. 14(*c*).

For example, the pulse width cp of each of the cancellation pulses shown in FIG. 14(*a*)-FIG. 14(*c*) is greater than AL. Contrarily, the pulse width of the cancellation pulse in each of the driving waveforms 53-7, 53-4 and 53-2 shown in FIG. 17(*a*)-FIG. 17(*c*) is smaller than AL. Generally, the duration of the driving waveform is also shortened if the pulse width of the cancellation pulse is reduced. Though the duration of the driving waveform is shortened, the repetition period of the driving waveform can be early. Thus, generally, the pulse width of the cancellation pulse is adjusted within a range shorter than the AL.

Figure 18A:
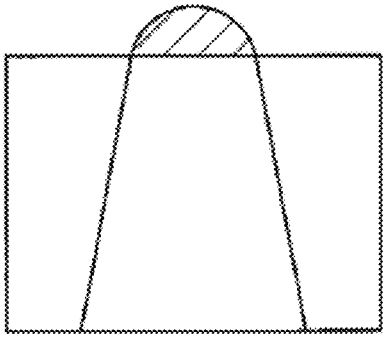
FIG. 18(*a*) is a schematic diagram illustrating the protrusion of a meniscus formed after the ejection of an ink droplet from a nozzle.
Figure 18B:
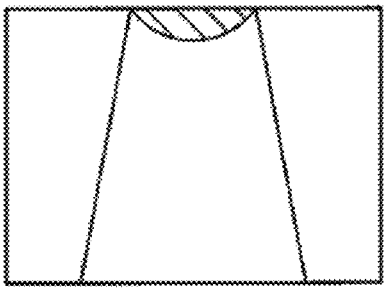

FIG. 18(*a*) is a schematic diagram illustrating the protrusion of a meniscus formed after the ejection of an ink droplet from the nozzle. In FIG. 18(*a*), it is set that the volume of the ink indicated by oblique lines right above the opening of the nozzle indicates the amount of the protrusion of the meniscus. FIG. 18(*b*) is a schematic diagram illustrating a state in which the meniscus is indented. In FIG. 18(*b*), the negative value of the amount of the protrusion of the meniscus indicates the volume of the external air existing in the nozzle and indicated by oblique lines.

That is, if the amount of the protrusion of a meniscus is a negative value, it means that the suck of the meniscus corresponding to the amount of the volume thereof occurs. If the next driving waveform is input in the presence of a big protrusion of the meniscus, then the volume of an ink droplet ejected based on the next driving waveform is changed. Thus, the timing at which the next driving waveform is input is necessarily determined with the amount of the protrusion of a meniscus taken into consideration.

Figure 19:
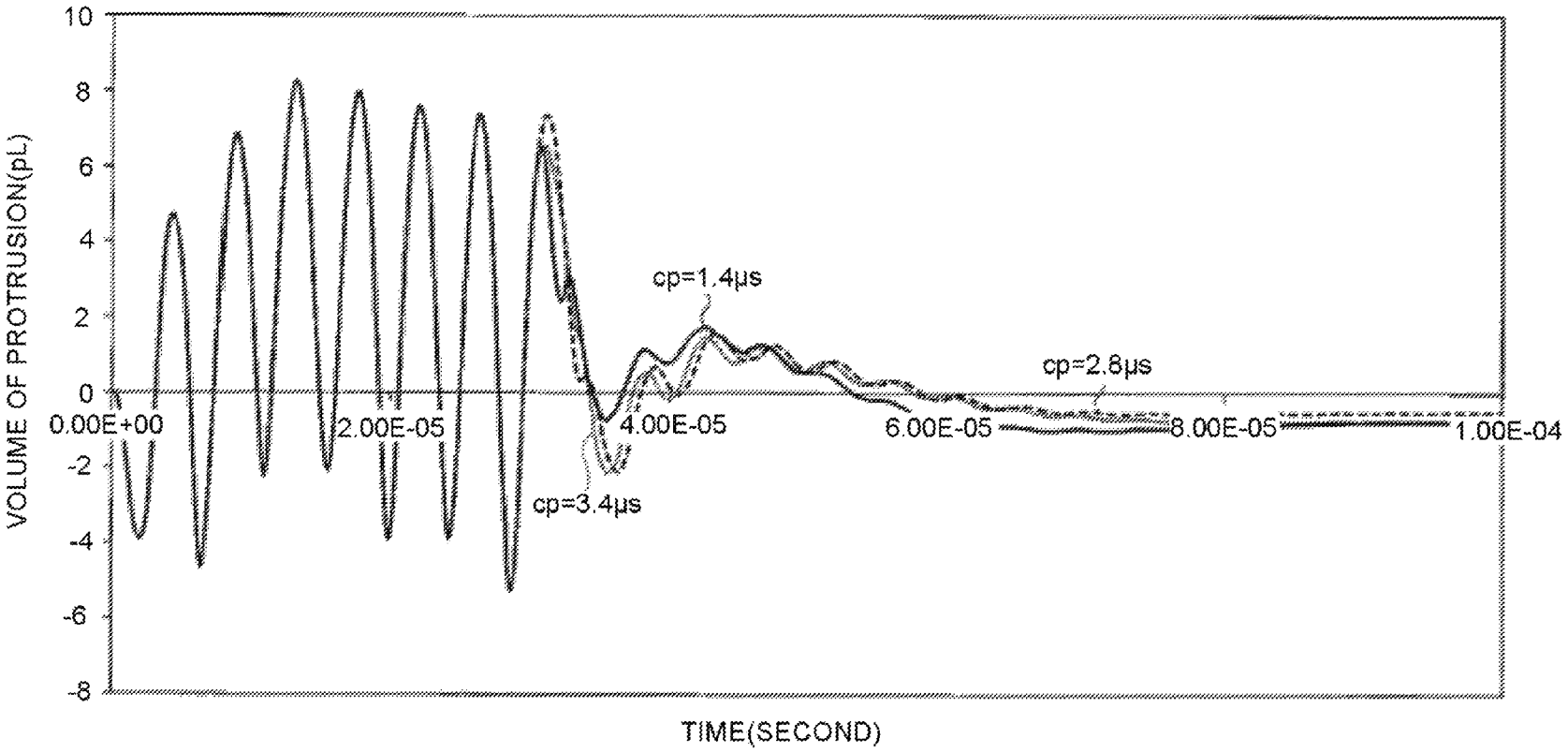
FIG. 19 is a diagram illustrating the change in the amount of the protrusion of a meniscus with the time when the pulse width of the cancellation pulse of a driving waveform in a case of the continuous ejection of seven ink droplets is changed.

FIG. 19 is a diagram illustrating the change in the amount of the protrusion of a meniscus with the time when the pulse width of the cancellation pulse included in a driving waveform in a case of the continuous ejection of seven ink droplets is changed.

In FIG. 19, the horizontal axis indicates time, and the vertical axis indicates the amount of the protrusion of a meniscus. For example, it is set that the vertical axis indicates the value of the ink amount which exists in a range within 50 μm from the surface of the nozzle plate in an ink ejection direction. Further, as stated above, the negative value serving as a phenomenon contrary to a convex meniscus indicates the volume of the external air drawn into the nozzle because of the indent of the meniscus. FIG. 19 shows a case where the pulse width cp of the cancellation pulse is 1.4 μs, a case where the pulse width cp of the cancellation pulse is 2.8 μs and a case where the pulse width cp of the cancellation pulse is 3.4 μs. It is assumed that AL is 2.2 μs. Thus, 1.4 μs is below AL, and 2.8 μs and 3.4 μs are above AL.

Further, the seven ink droplets ejected by the driving waveform depart from the range of 50 μm from the surface of the nozzle plate after 35 μs elapses from the time when the driving waveform is input. Thus, as shown in FIG. 19, the value of the vertical axis corresponding to the time value greater than 35 μs indicates the amount of the protrusion of a meniscus after the ejection of an ink droplet. In the example shown in FIG. 19, the amount of the protrusion of a meniscus is maximal at the time point of 42.5 μs and minimal at the time point of 70 μs when the pulse width of the cancellation pulse is 1.4 μs. Thus, the difference between the maximal value and the minimal value of the protrusion of a meniscus in a case where the pulse width of the cancellation pulse is 1.4 μs is larger than that in the other two cases where the pulse widths of the cancellation pulses are greater than AL.

FIG. 20 is a diagram summarizing the maximal value and the minimal value of the protrusion of a meniscus formed after the ejection of an ink droplet.

FIG. 20 indicates the maximal value and the minimal value of the protrusion of a meniscus in a case of three kinds of the pulse widths of the cancellation pulses. The maximal value and the minimal value of the protrusion of a meniscus are 1.73 and −0.99, resulting in a difference of 2.72 in a case in which the pulse width of the cancellation pulse is 1.4 μs. In a case in which the pulse width of the cancellation pulse is 2.8 μs, the maximal value and the minimal value of the protrusion of a meniscus are 1.45 and −0.77, resulting in a difference of 2.22. In a case in which the pulse width of the cancellation pulse is 3.4 μs, the maximal value and the minimal value of the protrusion of a meniscus are 1.58 and −0.57, resulting in a difference of 2.15.

According to FIG. 20, the difference between the maximal value and the minimal value of the protrusion of a meniscus when the pulse width of the cancellation pulse is below AL is greater than that between the maximal value and the minimal value of the protrusion of a meniscus when the pulse width of the cancellation pulse is above AL. That is, the difference between the maximal value and the minimal value of the protrusion of a meniscus can be reduced if the pulse width of the cancellation pulse is set to be above AL.

Then, it is assumed that the manufacture methods of nozzles in the inkjet head are different.

In a case of a drive signal of which the difference between the maximal value and the minimal value of the protrusion of a meniscus is large, the meniscus behaviours greatly differ due to the difference in manufacture method of the nozzle. Thus, it is needed to adjust the pulse width of the cancellation pulse for each nozzle. However, the inkjet head drive apparatus according to the present embodiment applies a voltage V2 to the air chambers at two sides adjacent to pressure chambers through the cancellation pulse. The air chambers at two sides are also adjacent to the pressure chambers of two nozzles adjacent to the nozzle. Thus, limitations are imposed on the adjustment of the time of the cancellation pulse for each nozzle.

For example, in FIG. 6(*b*), a potential difference of −V2 is applied to the electrode 21*d*, thus, a voltage of V2 is applied to the electrodes 21*c* and 21*e* adjacent to the electrode 21*d*. In FIG. 6(*b*), the potential difference is illustrated which is applied to the electrode 21*b* while the potential difference of the electrode 21*d* is kept at −V2. First, if the electrode 21*b* is applied with a voltage of V2, then the potential difference between the electrode 21*b* and an adjacent electrode becomes 0. Then, a voltage of 0 may be applied to the electrode 21*b* so as to change the potential difference between the electrode 21*b* and an adjacent electrode to −V2 (input a cancellation pulse for the electrode 21*b*). However, in order to change the potential difference between the electrode 21*b* and an adjacent electrode to V2 (input the first ejection pulse for the electrode 21*b*), a voltage which is twice as large as V2 is needed to be applied to the electrode 21*b*, which means that a new voltage source with a voltage value of double V2 is needed.

Further, the driver IC 4 with the structure shown in FIG. 7 cannot apply a potential difference of −V2 to one nozzle and a potential difference of V2 to the other nozzle adjacent to the nozzle at the same moment. Thus, there are limitations to the adjustment of the timing of the cancellation pulse for each nozzle. As a result, the inkjet head drive apparatus according to the present embodiment is not required to adjust the cancellation pulse of each nozzle separately but is required to keep the difference between the maximal value and the minimal value of the protrusion of a meniscus after the ejection of an ink droplet small.

Figure 22:
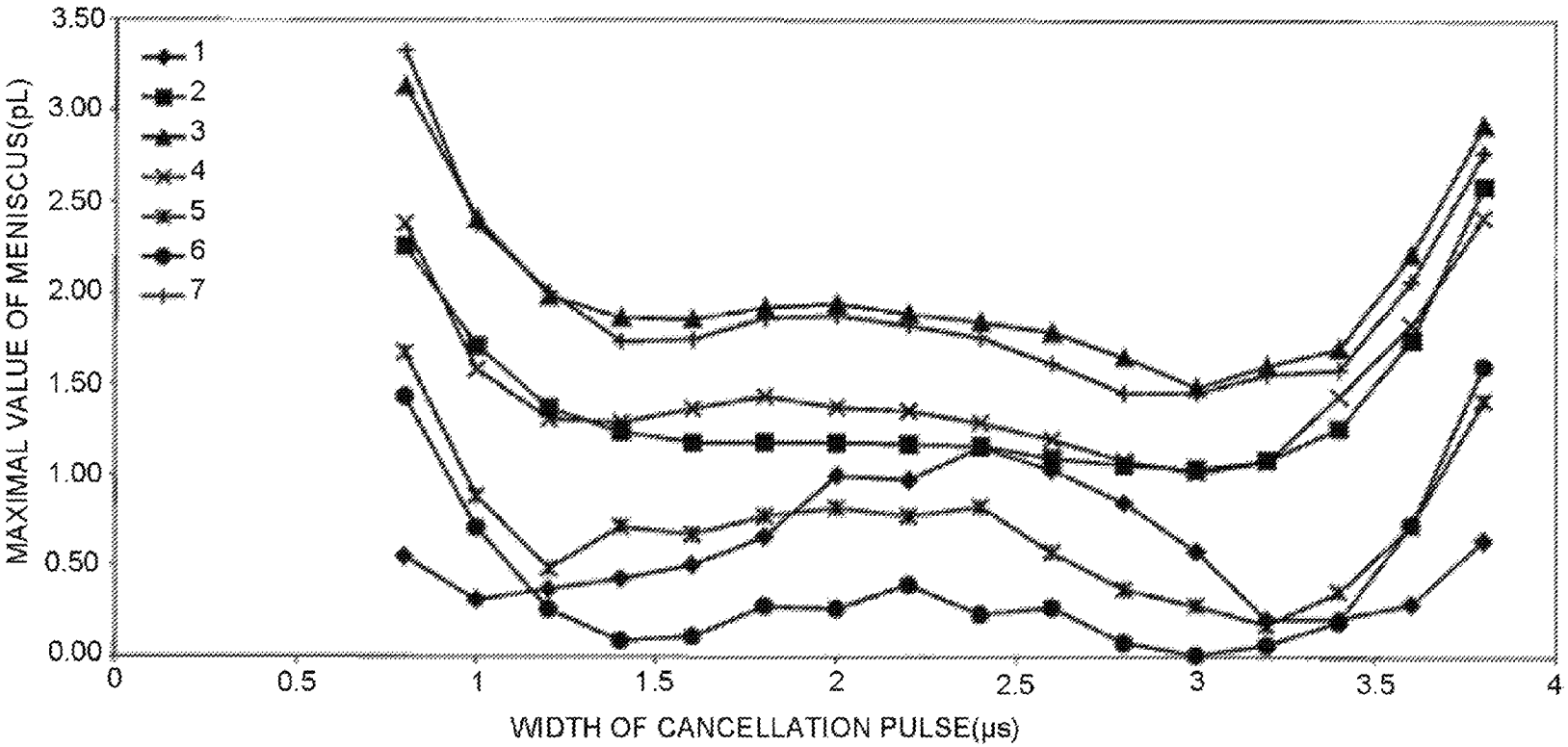
FIG. 22 is a diagram illustrating the graphed values shown in FIG. 21.

FIG. 21 is a diagram exemplifying the maximal value of the protrusion of a meniscus when the number of the continuously ejected ink droplets and the pulse width of the cancellation pulse are changed; FIG. 22 is a diagram illustrating the graphed values shown in FIG. 21. FIG. 21 and FIG. 22 indicate the change in the maximal value of the protrusion of a meniscus when the pulse width of the cancellation pulse of a driving waveform is changed from 8 μs to 38 μs for each number of continuously ejected ink droplets.

Further, in FIG. 21 and FIG. 22, it is set that AL is 2.2 μs, the interval between pulses is 4.4 μs, the potential difference (the first voltage amplitude) of the first ejection pulse is 25(v), and the potential difference (the second voltage amplitude) of the second ejection pulse is 16(v). Further, it is set that the pulse width of the second ejection pulse for each number of ink droplets that are continuously ejected is equal to that shown in FIG. 15. According to FIG. 21 and FIG. 22, the pulse width in the waveform of the cancellation pulse in which the amount of the protrusion of a meniscus is minimal is a value equal to or greater than AL regardless of the number of the ink droplets that are continuously ejected.

Figures 23, 24:
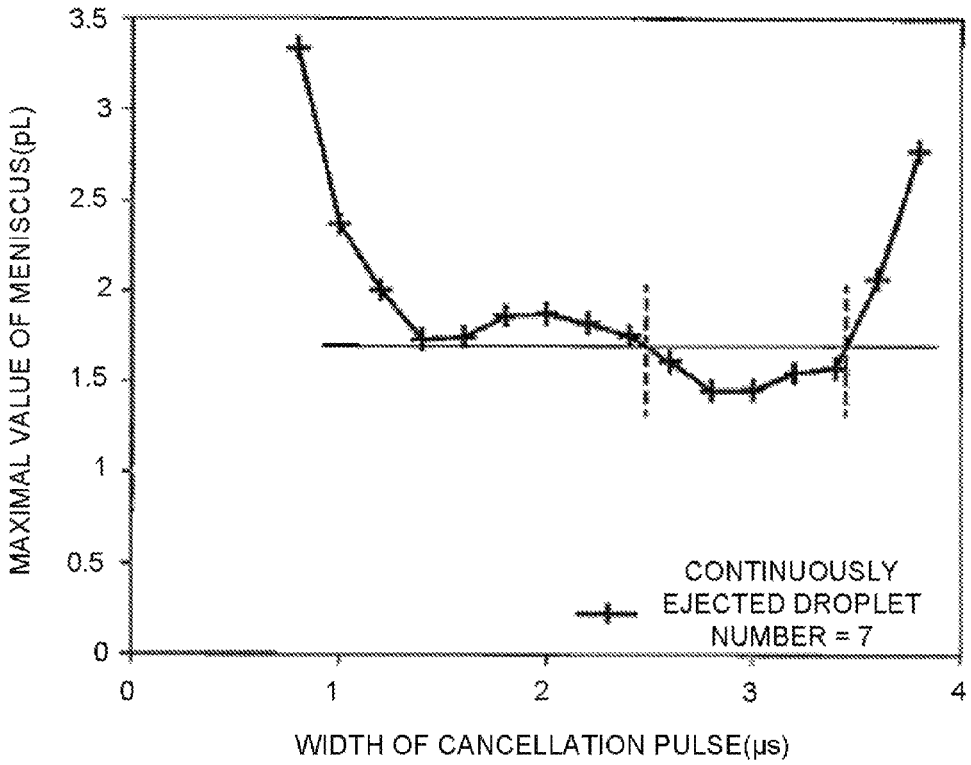
FIG. 23 is a diagram illustrating the relationship between the maximal values of the protrusion of a meniscus and the pulse widths of a cancellation pulse in a case in which the number of continuously ejected ink droplets is 7.
FIG. 24 is a diagram illustrating the range smaller than the minimal value of the amount of the protrusion of a meniscus within AL when the pulse width of the cancellation pulse is above AL.

FIG. 23 is a diagram illustrating the relationship between the maximal value of the protrusion of a meniscus and the pulse width of a cancellation pulse in the case of the continuous ejection of seven ink droplets. FIG. 23 shows the range of the minimal value the amount of the protrusion of a meniscus within AL when the pulse width of a cancellation pulse is above AL. FIG. 24 is a diagram summarizing the range smaller than the minimal value of the amount of the protrusion of a meniscus within AL when the pulse width of a cancellation pulse is above AL. That is, if the pulse width of the cancellation pulse is set to be equal to or greater than AL, then the amount of the protrusion of a meniscus after the ejection of an ink droplet can be reduced.

As stated above, the amount of the protrusion of a meniscus formed after the ejection of an ink droplet can be reduced by setting the pulse width of the cancellation pulse to be a value equal to or greater than AL. The inkjet head drive apparatus is improved in print quality through reducing the amount of the protrusion of a meniscus after the ejection of an ink droplet.

Next, a modification of the foregoing embodiment is described below.

Figure 25:
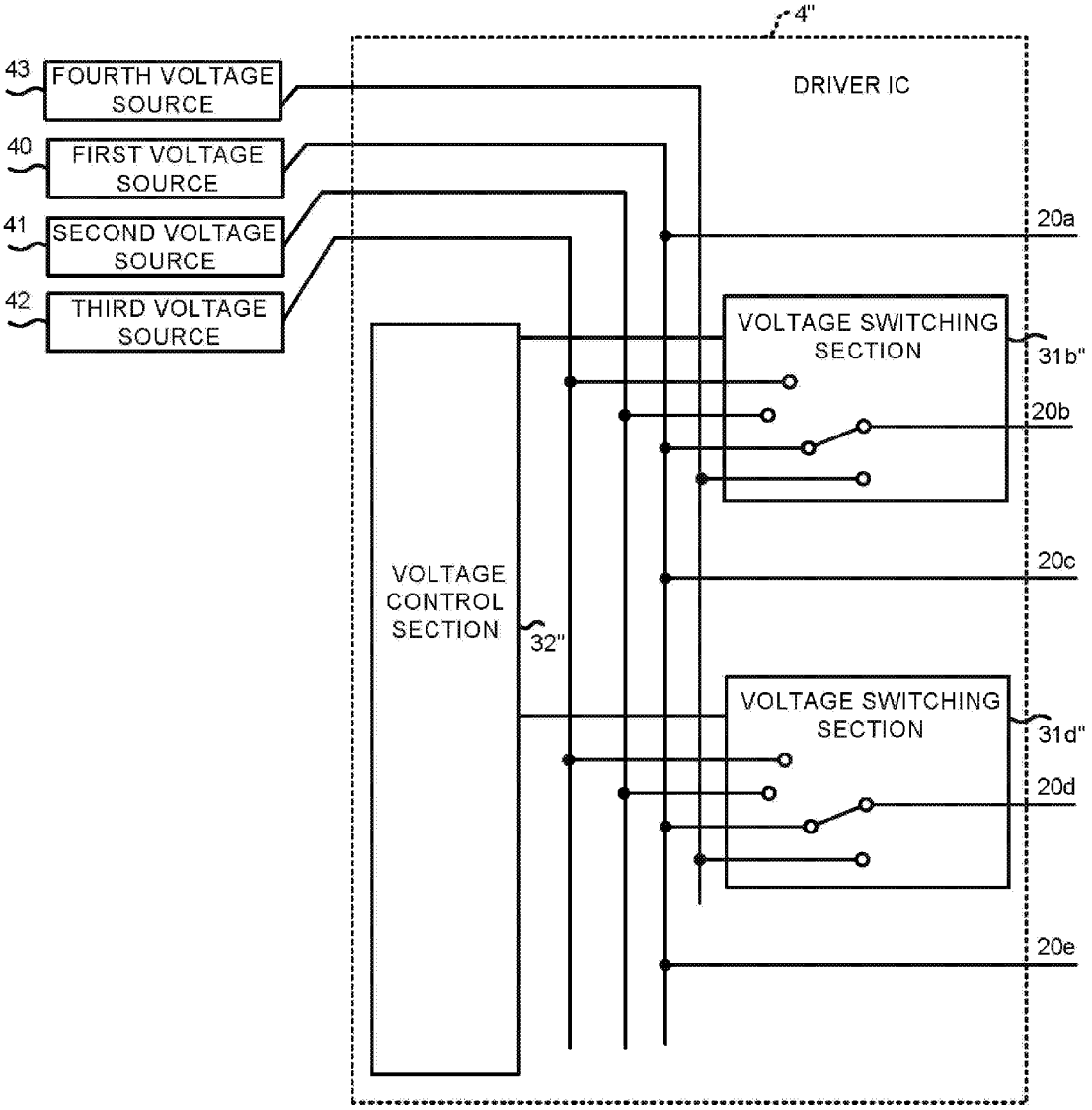
FIG. 25 is a diagram illustrating a third structure example of the driver IC applicable to the inkjet recording apparatus according to the embodiment.

FIG. 25 is a diagram illustrating a structure example (a third structure example) of a driver IC applicable to the inkjet recording apparatus according to the modification of the foregoing embodiment.

As shown in FIG. 25, a driver IC 4" is connected with four voltage sources (a first voltage source 40, a second voltage source 41, a third voltage source 42 and a fourth voltage source 43). The voltage value of the fourth voltage source 43 is −V2, which provides a third voltage amplitude used in a cancellation pulse. Voltage switching sections 31*b*" and 31*d*" connect any one of the first to the fourth voltage sources 40-43 with wiring electrodes 20*b* and 20*d* under the control of a voltage control section 32". The wiring electrodes 20*b* and 20*d* are connected with electrodes 21*b* and 21*d* on the inner walls of pressure chambers. On the other hand, the electrodes 21*a*, 21*c* and 21*e* formed on inner walls of air chambers are connected with the first voltage source 40 via wiring electrodes 20*a*, 20*c* and 20*e*.

Further, as shown in FIG. 25, in the driver IC 4", the wiring electrode connected with the electrode on the inner wall of an air chamber is connected with the first voltage source 40; however, the layout of the wiring of the wiring electrode connected with the electrode on the inner wall of the air chamber can be changed to make the wiring electrode connect with the first voltage source 40 outside the driver IC 4". In this case, the wiring electrodes connected with the driver IC 4" only are the wiring electrodes connected with the electrodes on the inner walls of pressure chambers.

For example, when a cancellation pulse is input for the nozzle 2*d* shown in FIG. 6(*b*), the driver IC 4" applies a voltage −V2 to the electrode 21*d* in the same way as shown in FIG. 6(*b*). That is, in addition to an ejection pulse, the driver IC 4" also easily adjusts the pulse width of a cancellation pulse for each nozzle. The cancellation pulse for each nozzle can be adjusted, thus, the driver IC 4" can accelerate the start time of the first ejection pulse if the number of continuously ejected ink droplets is below the maximum number.

Figure 26A:
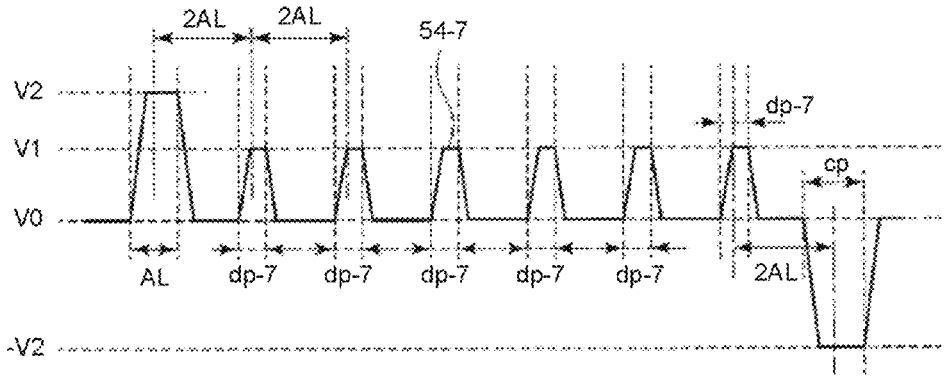
FIG. 26(*a*)-FIG. 26(*c*) exemplify driving waveforms that can be output by the driver IC relating to the third structure example.
Figure 26B:
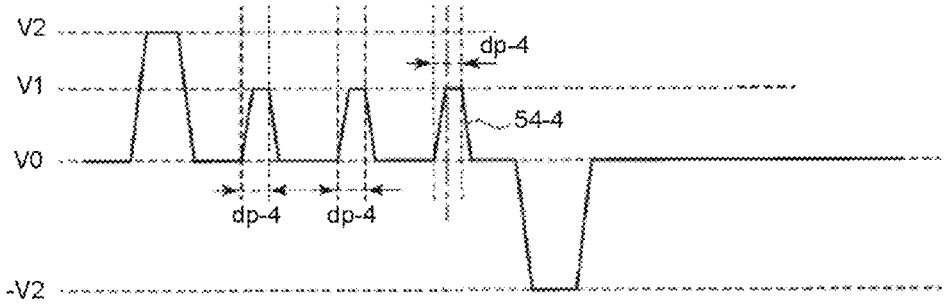
Figure 26C:
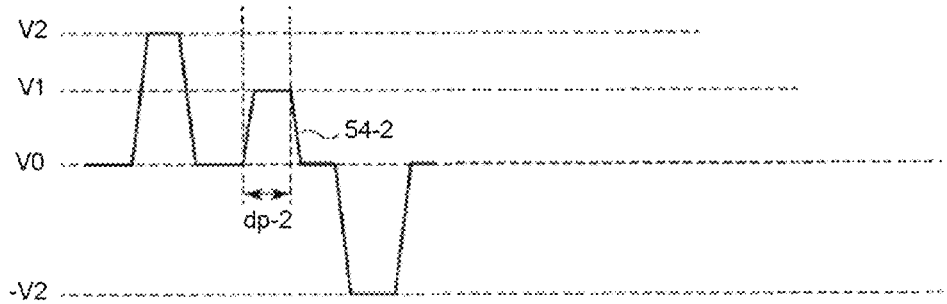

For example, FIG. 26(*a*)-FIG. 26(*c*) are diagrams exemplifying driving waveforms 54-7,54-4 and 54-2 that can be output by the driver IC4". FIG. 26(*a*) exemplifies the driving waveform 54-7 in a case in which the number of continuously ejected ink droplets is the maximum number "7". FIG. 26(*b*) exemplifies the driving waveform 54-4 in a case in which the number of continuously ejected ink droplets is "4" smaller than the maximum number. FIG. 26(*c*) exemplifies the driving waveform 54-2 in a case in which the number of continuously ejected ink droplets is "2' smaller than the maximum number.

As shown in FIG. 26(*b*) or FIG. 26(*c*), the driver IC 4" can shorten the time needed for the start of the first ejection pulse if the number of continuously ejected ink droplets is below the maximum number. By shortening the time needed for the start of the first ejection pulse, the time after the input of the cancellation pulse until the input of the next driving waveform can be increased. For example, in FIG. 21 and FIG. 22, the amount of the protrusion of a meniscus is maximal when the number of continuously ejected ink droplets is 3. If the number of continuously ejected ink droplets is 3, then the driver IC 4" can shorten the time needed for starting the first ejection pulse only within a time range corresponding to at most 4 (7−3) pulses.

That is, if the time after the input of the cancellation pulse until the input of the next driving waveform is longer, then the amount of the protrusion of the meniscus gets smaller as time elapses, which causes less influence on the volume of the next ejected ink droplet. Consequentially, the print quality of the inkjet recording apparatus is improved.

The inkjet head drive apparatuses according to the foregoing embodiments are summarized as follows:

(1)

An inkjet head drive apparatus comprises a pressure chamber in which an ink is housed; a nozzle connected with the pressure chamber to eject the ink housed in the pressure chamber; an actuator configured to increase or decrease volume of the pressure chamber; and a drive signal output section configured to output a drive signal including an ejection pulse for ejecting the ink by increasing or decreasing the volume of the pressure chamber to the actuator. The inkjet head drive apparatus changes the amount of ejected ink droplets by changing times the ejection pulse included in the drive signal is repeated, the values of the voltage amplitudes of the ejection pulses included in the drive signal output from the drive signal output section at least has two kinds, and in a case where the ejection pulse is repeated for equal to or greater than three times, the voltage amplitude of the ejection pulse after the initial ejection pulse is smaller when compared with the voltage amplitude of the initial ejection pulse included in the drive signal, and the voltage amplitudes of the second ejection pulse and pulses thereafter are equal to each other.

(2)

In the inkjet head drive apparatus according to the (1), the drive signal output section is connected with at least three voltage sources having different voltage values, and the value of the voltage amplitude of the ejection pulse output to the actuator is changed by switching the voltage sources connected with the actuator.

(3)

In the inkjet head drive apparatus according to the (1) or (2), if a half of the cycle of the main acoustic resonance frequency of the ink in the pressure chamber is set to be AL, then the pulse width of the initial ejection pulse included in the driving waveform is nearly AL, and those of the second ejection pulse and pulses thereafter are nearly below AL.

(4)

In the inkjet head drive apparatus according to the (3), the interval between the centers of pulse widths of successive ejection pulses included in the driving waveform is substantially twice as long as AL.

(5)

In the inkjet head drive apparatus according to the (3) or (4), if the width of each ejection pulse included in the driving waveform is nearly AL and the interval between the centers of the pulse widths of successive ejection pulses is substantially twice as long as AL, then the voltage amplitudes of the second ejection pulse and pulses thereafter is a voltage amplitude which enables the speed of the ink droplet ejected by the last ejection pulse to be equal to or higher than that of the ink droplet ejected by the initial ejection pulse.

(6)

In the inkjet head drive apparatus according to any one of the (1)-(5), the driving waveform includes a flow-in and flow-out suppression pulse for suppressing the flow of the ink into or out of the nozzle and the pressure chamber which is set after the repeated ejection pulses.

(7)

In the inkjet head drive apparatus according to the (6), the voltage amplitude of the flow-in and flow-out suppression pulse is a value different from the two kinds of voltage amplitudes recorded in the (1).

(8)

In the inkjet head drive apparatus according to the (6), the pulse width of the flow-in and flow-out suppression pulse is equal to or greater than AL.

The inkjet head drive apparatuses according to the foregoing embodiments consumes less power while being expanded in size to the smallest degree.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An inkjet head drive apparatus, comprising:

a pressure chamber configured to accommodate an ink;

an actuator configured to increase or decrease volume of the pressure chamber through an applied voltage;

a nozzle configured to be connected with the pressure chamber to eject the ink through change in the volume of the pressure chamber; and a drive signal output section configured to output, if an ejection pulse for the ejection of the ink from the nozzle is repeated for equal to or greater than three times, a drive signal of a driving waveform including an initial ejection pulse having a first voltage amplitude and a second ejection pulses and pulses thereafter having a second voltage amplitude smaller than the first voltage amplitude to the actuator, the drive signal output section is at least connected with three kinds of voltage sources having different voltage values, and changes the value of the voltage amplitude of the ejection pulse output to the actuator by switching the voltage sources connected with the actuator.

2. The inkjet head drive apparatus according to claim 1, wherein the drive signal output section sets the pulse width of the initial ejection pulse to be a time that is half of the cycle of the main acoustic resonance frequency of the ink in the pressure chamber, sets the pulse width of each of a second ejection pulses and the pulses thereafter to be below the time that is half of the cycle of the main acoustic resonance frequency, and sets the interval between the centers of the pulse widths of successive ejection pulses in the driving waveform to be the cycle of the main acoustic resonance frequency.

3. The inkjet head drive apparatus according to 1, wherein the drive signal output section sets the pulse width of the initial ejection pulse to be a time that is half of the cycle of the main acoustic resonance frequency of the ink in the pressure chamber, sets the pulse width of each of a second ejection pulses and the pulses thereafter to be below the time that is half of the cycle of the main acoustic resonance frequency, and sets the interval between the centers of the pulse widths of successive ejection pulses in the driving waveform to be the cycle of the main acoustic resonance frequency.

4. The inkjet head drive apparatus according to claim 1, wherein the second voltage amplitude is a voltage amplitude which enables speed of an ink droplet ejected with last ejection pulse to be higher than that of an ink droplet ejected by an initial ejection pulse.

5. The inkjet head drive apparatus according to claim 1, wherein the drive signal output section generates a driving waveform which includes a flow-in and flow-out suppression pulse for suppressing the flow of the ink into or out of the nozzle and the pressure chamber which is set after the repeating of ejection pulses.

6. An inkjet head drive apparatus, comprising:

an actuator configured to increase or decrease volume of a pressure chamber accommodating an ink through an applied voltage;

a nozzle plate configured to contain a nozzle to be connected with the pressure chamber to eject the ink through change in the volume of the pressure chamber;

a switch configured to switch connection between the actuator and a plurality of voltage sources; and a drive circuit configured to output, if an ejection pulse for the ejection of the ink from the nozzle is repeated for several times, a drive signal of a driving waveform including an initial ejection pulse having a first voltage amplitude and a second ejection pulse having a second voltage amplitude smaller than the first voltage amplitude to the actuator, wherein the drive circuit includes the switch.

7. The inkjet head according to claim 6, wherein the drive circuit outputs the second voltage amplitude for several times.

8. The inkjet head according to claim 7, wherein the drive circuit sets a same amplitude to the second voltage amplitude output for several times.

9. An inkjet head drive method, comprising:

increasing or decreasing volume of a pressure chamber accommodating an ink through an applied voltage;

ejecting the ink by changing the volume of the pressure chamber through a nozzle of a nozzle plate connected with the pressure chamber;

switching a connection between an actuator used for increasing or decreasing the volume of a pressure chamber and a plurality of voltage sources; and outputting, if an ejection pulse for the ejection of the ink from the nozzle is repeated for several times, a drive signal of a driving waveform including an initial ejection pulse having a first voltage amplitude and a second ejection pulse having a second voltage amplitude smaller than the first voltage amplitude to the actuator.

10. The inkjet head drive method according to claim 9, further comprising:

outputting the second voltage amplitude for several times.

11. The inkjet head drive method according to claim 10, further comprising:

setting a same amplitude to the second voltage amplitude output for several times.

* * * * *